US010210877B2

(12) United States Patent
Kawashima et al.

(10) Patent No.: US 10,210,877 B2
(45) **Date of Patent: *Feb. 19, 2019**

(54) SPEECH AUDIO ENCODING DEVICE, SPEECH AUDIO DECODING DEVICE, SPEECH AUDIO ENCODING METHOD, AND SPEECH AUDIO DECODING METHOD

(71) Applicant: PANASONIC INTELLECTUAL PROPERTY CORPORATION OF AMERICA, Torrance, CA (US)

(72) Inventors: Takuya Kawashima, Ishikawa (JP); Masahiro Oshikiri, Osaka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/848,841

(22) Filed: Dec. 20, 2017

(65) Prior Publication Data

US 2018/0114535 A1 Apr. 26, 2018

Related U.S. Application Data

(63) Continuation of application No. 15/590,360, filed on May 9, 2017, now Pat. No. 9,892,740, which is a (Continued)

(30) Foreign Application Priority Data

Nov. 5, 2012 (JP) ..... 2012-243707
May 31, 2013 (JP) ..... 2013-115917

(51) Int. Cl.
*G10L 19/02* (2013.01)
*G10L 19/032* (2013.01)
(Continued)

(52) U.S. Cl.
CPC ..... *G10L 19/0204* (2013.01); *G10L 19/002* (2013.01); *G10L 19/02* (2013.01);
(Continued)

(58) Field of Classification Search
USPC ..... 704/206, 229, 500–504
See application file for complete search history.

(56) References Cited

U.S. PATENT DOCUMENTS 6,353,808 B1 3/2002 Matsumoto et al.
6,424,939 B1 7/2002 Herre et al.
(Continued)

FOREIGN PATENT DOCUMENTS

EP 2490215 8/2012
JP 63-37400 2/1988
(Continued)

OTHER PUBLICATIONS

ITU-T, G.729.1, "Amendment 6: New Annex E on superwideband scalable extension", Telecommunication Standardization Sector of International Telecommunications Union, Mar. 2010, pp. 1-69.
(Continued)

*Primary Examiner* — Leonard Saint Cyr
(74) *Attorney, Agent, or Firm* — Greenblum & Bernstein, P.L.C.

(57) ABSTRACT

A speech/audio decoding apparatus is provided that includes a receiver that receives encoded data including a limited-band mode flag, and a memory that stores information on a position of a maximum amplitude spectrum frequency of a previous frame in a divided band. The speech/audio decoding apparatus also includes a processor that identifies whether a decoding band is encoded using a limited-band mode based on the decoded limited-band mode flag. Additionally, the processor decodes the spectrum in a limited band within each of the divided bands in a current frame
(Continued)

using the stored information. Furthermore, the limited-band mode is set at an encoder side, when a difference between a first frequency with a first maximum amplitude in a spectrum of the divided band in a preceding frame and a second frequency with a second maximum amplitude in a spectrum of the divided band in the current frame is below a threshold.

8 Claims, 19 Drawing Sheets

Related U.S. Application Data continuation of application No. 14/439,090, filed as application No. PCT/JP2013/006496 on Nov. 1, 2013, now Pat. No. 9,679,576.

(51) Int. Cl.
*G10L 19/002* (2013.01)
*G10L 21/038* (2013.01)
*G10L 19/24* (2013.01)

(52) U.S. Cl.
CPC ..... *G10L 19/0212* (2013.01); *G10L 19/032* (2013.01); *G10L 19/24* (2013.01); *G10L 21/038* (2013.01)

(56) References Cited

U.S. PATENT DOCUMENTS

| | | | |
|---|---|---|---|
| 2002/0010577 | A1 | 1/2002 | Matsumoto et al. |
| 2002/0013703 | A1 | 1/2002 | Matsumoto et al. |
| 2004/0091026 | A1 | 5/2004 | Nakayama |
| 2005/0261893 | A1 | 11/2005 | Toyama et al. |
| 2008/0312758 | A1 | 12/2008 | Koishida et al. |
| 2009/0234653 | A1 | 9/2009 | Kawashima et al. |
| 2010/0114581 | A1 | 5/2010 | Li et al. |
| 2010/0166225 | A1 | 7/2010 | Watanabe et al. |
| 2010/0169081 | A1 | 7/2010 | Yamanashi et al. |
| 2010/0280833 | A1 | 11/2010 | Yamanashi et al. |
| 2011/0035214 | A1 | 2/2011 | Morii |
| 2012/0029923 | A1 | 2/2012 | Rajendran et al. |

FOREIGN PATENT DOCUMENTS

| | | |
|---|---|---|
| JP | 07-147566 | 6/1995 |
| JP | 2000-132194 | 5/2000 |
| JP | 2002-372995 | 12/2002 |
| JP | 2002-374171 | 12/2002 |
| JP | 2004-094090 | 3/2004 |
| JP | 2010-506207 | 2/2010 |

OTHER PUBLICATIONS

ITU-T, G.719, "Low-complexity, full-band audio coding for high-quality, conversational applications", Telecommunication Standardization Sector of International Telecommunications Union, Jun. 2008, pp. 1-50.

ITU-T, G.718, "Amendment 2: New Annex B on superwideband scalable extension for ITU-T G.718 and corrections to main body fixed-point C-code and description text", Telecommunication Standardization Sector of International Telecommunications Union, Mar. 2010, pp. 1-51.

Karlheinz Brandenburg, "MP3 and AAC Explained", AES 17th International Conference on High Quality Audio Coding, 1999, pp. 1-12.

International Search Report, dated Jan. 14, 2014, in corresponding International Application No. PCT/JP2013/006496.

Extended European Search Report, dated Nov. 9, 2015, from the European Patent Office (E.P.O.) in the corresponding European Patent Application No. 13850858.5.

SPEECH AUDIO ENCODING DEVICE, SPEECH AUDIO DECODING DEVICE, SPEECH AUDIO ENCODING METHOD, AND SPEECH AUDIO DECODING METHOD

CROSS-REFERENCE TO RELATED APPLICATION

This is a continuation application of U.S. patent application Ser. No. 15/590,360, filed May 9, 2017, which is a continuation application of U.S. patent application Ser. No. 14/439,090, filed Apr. 28, 2015, which is the U.S. National Stage International Application No. PCT/JP2013/006496 filed Nov. 1, 2013, which claims priority to Japanese Application Nos. 2013-115917, filed May 31, 2013 and 2012-243707 filed Nov. 5, 2012. The disclosures of these documents, including the specifications, drawings and claims, are incorporated herein by reference in their entirety.

TECHNIQUE FIELD

The present invention relates to a speech/audio coding apparatus, a speech/audio decoding apparatus, a speech/audio coding method and a speech/audio decoding method using a transform coding scheme.

BACKGROUND ART

As a scheme capable of efficiently encoding a speech signal or music signal in an ultra-wideband (SWB: Super-Wide-Band) of 0.05 to 14 kHz, there are techniques disclosed in Non-Patent Literature (hereinafter, referred to as "NPL") 1 and NPL 2 standardized in ITU-T (International Telecommunication Union Telecommunication Standardization Sector). According to these techniques, a band of up to 7 kHz is encoded by a core coding section and a band of 7 kHz or higher (hereinafter referred to as "extended band") is encoded by an enhanced coding section.

The core coding section performs coding using code excited linear prediction (CELP), transforms a residual signal that cannot be encoded by CELP into a frequency domain through MDCT (Modified Discrete Cosine Transform) and then encodes the transformed residual signal through transform coding such as FPC (Factorial Pulse Coding) or AVQ (Algebraic Vector Quantization). The enhanced coding section performs coding using a technique of searching for a band having a high correlation with a low band spectrum of up to 7 kHz in an extended band of 7 kHz or higher and using a band having the highest correlation for coding of the extended band. According to NPL 1 and NPL 2, the number of coded bits is predetermined for the low band side of up to 7 kHz and the high band side of 7 kHz or higher respectively and the low band side and the high band side are encoded with the respectively determined numbers of coded bits.

NPL 3 also discloses that a scheme for encoding SWB is standardized in ITU-T. The coding apparatus according to NPL 3 transforms an input signal into a frequency domain through MDCT, divides the input signal into subbands and performs encoding on a subband basis. More specifically, this coding apparatus first calculates energy of each subband and performs encoding. Next, the coding apparatus allocates coded bits for encoding a frequency fine structure to each subband based on the subband energy for encoding the frequency fine structure. The frequency fine structure is encoded using lattice vector quantization. As with FPC or AVQ, lattice vector quantization is also a kind of transform coding suitable for spectrum coding. Since coded bits are not sufficiently allocated in lattice vector quantization, there may be a large error between the energy of the decoded spectrum and the subband energy. In this case, coding is performed through processing of filling the error between the subband energy and the energy of the decoded spectrum with a noise vector.

NPL 4 discloses a coding technique using AAC (Advanced Audio Coding). AAC calculates a masking threshold based on a perceptual model, excludes MDCT coefficients equal to or lower than the masking threshold from coding targets and thereby efficiently performs coding.

CITATION LIST

Non-Patent Literature

NPL 1
ITU-T Standard G.718 AnnexB, 2010
NPL 2
ITU-T Standard G.729.1 AnnexE, 2010
NPL 3
ITU-T Standard G.719, 2008
NPL 4
MP3 AND AAC explained, AES 17th International Conference on High Quality Audio Coding, 1999

SUMMARY OF INVENTION

Technical Problem

According to NPL 1 and NPL 2, bits are fixedly allocated to the low band side to be encoded by the core coding section and the high band side to be encoded by the enhanced coding section, and it is not possible to appropriately allocate coded bits to the low band and the high band according to characteristics of signals. For this reason, there is a problem that sufficient performance cannot be exhibited depending on the characteristics of input signals.

Meanwhile, according to NPL 3, a mechanism is provided to adaptively allocate bits from the low band to the high band according to the energy of subbands, but focusing on a perceptual characteristic that the higher the band, the lower is sensitivity to a spectral error, there is a problem that more than necessary bits are likely to be allocated to the high band. These problems will be described below.

In a coding process, a bit amount necessary for each subband is calculated so that the greater the subband energy calculated for each subband, the more bits are allocated. However, with transform coding, according to the nature of algorithm, even when the number of coded bits allocated is increased by one bit, the coding performance may not improve and the coding result may not change unless a certain substantial number of bits are allocated. For this reason, it may be convenient if bits are allocated not bit by bit but in units of a certain substantial number of bits. Such a unit of bits necessary for coding is called a "unit" hereinafter. The greater the number of units allocated, the more accurately the shape and amplitude of a spectrum can be expressed. It is a general practice, in consideration of the perceptual characteristic, that a wider bandwidth is taken for subbands in a higher band than in a lower band, but the wider the bandwidth, the more bits are necessary for one unit, and therefore the number of bits per unit is changed according to the bandwidth.

In transform coding considered in the present invention, since a spectrum is approximated by a small number of pulse sequences in a frequency domain, coded bits allocated on a unit basis to the amplitude information and the position information are consumed.

In addition, according to NPL 4, coding is performed efficiently by excluding MDCT coefficients which are not important in terms of perceptual characteristics from coding targets, but position information of individual spectra to be encoded is precisely expressed. For this reason, the wider the bandwidth of a subband, the more bits need to be consumed to express positions of individual spectra.

However, perceptual sensitivity to a spectral position deteriorates as the band becomes higher, and if main spectral amplitude and subband energy can be expressed, perceptual deterioration is hardly perceived. Nevertheless, according to NPL 3 and NPL 4, more bits are consumed also in a high band so that positions of individual spectra may be expressed precisely. That is, there is a problem that more than necessary coded bits are used to precisely express spectral positions.

An object of the present invention is to provide a speech/audio coding apparatus, a speech/audio decoding apparatus, a speech/audio coding method and a speech/audio decoding method capable of reducing the number of coded bits to be allocated to coding of a spectrum of an extended band while preventing deterioration of sound quality in the extended band.

Solution to Problem

A speech/audio coding apparatus according to the present invention includes: a time/frequency transformation section that transforms a time-domain input signal into a frequency-domain spectrum; a dividing section that divides the spectrum into subbands; a band compression section that divides a spectrum in a subband within an extended band into combinations of a plurality of samples in order from a low band side or a high band side, that selects spectra having large absolute values of amplitude among the combinations, that tightly arranges the selected spectra in the frequency domain, and that compresses the band of the subband; and a transform coding section that encodes a spectrum of a subband lower than the extended band and a band-compressed spectrum through transform coding.

A speech/audio decoding apparatus according to the present invention includes: a transform coding decoding section that decodes coded data resulting from transform coding both a spectrum in a subband band obtained by dividing a spectrum of a subband within an extended band into combinations of a plurality of samples in order from a low band side or a high band side, selecting spectra having large absolute values of amplitude from among the combinations, tightly arranging the selected spectra in a frequency domain and compressing the band of the subband and a spectrum of a subband lower than the extended band; a band extension section that extends the bandwidth of the compressed subband to a bandwidth of the original subband; a subband integration section that integrates a spectrum of a subband lower than the decoded extended band and a spectrum of a subband within the extended band into one vector; and a frequency/time transformation section that transforms the integrated frequency-domain spectrum to a time-domain signal.

A speech/audio coding method according to the present invention includes: transforming a time-domain input signal into a frequency-domain spectrum; dividing the spectrum into subbands; dividing a spectrum in a subband within an extended band into combinations of a plurality of samples in order from a low band side or a high band side, selecting spectra having large absolute values of amplitude among the combinations, tightly arranging the selected spectra in the frequency domain and compressing the band of the subband; and encoding a spectrum of a subband lower than the extended band and a band-compressed spectrum through transform coding.

A speech/audio decoding method according to the present invention includes: decoding coded data resulting from transform coding both a spectrum in a subband band obtained by dividing a spectrum of a subband within an extended band into combinations of a plurality of samples in order from a low band side or a high band side, selecting spectra having large absolute values of amplitude from among the combinations, tightly arranging the selected spectra in a frequency domain and compressing the band of the subband and a spectrum of a subband lower than the extended band; extending the bandwidth of the compressed subband to a bandwidth of the original subband; integrating a spectrum of a subband lower than the decoded extended band and a spectrum of a subband within the extended band into one vector; and transforming the integrated frequency-domain spectrum to a time-domain signal.

Advantageous Effects of Invention

According to the present invention, it is possible to reduce the number of coded bits to be allocated to coding of a spectrum of an extended band while preventing deterioration of sound quality in the extended band.

DESCRIPTION OF EMBODIMENTS

Figure 1:
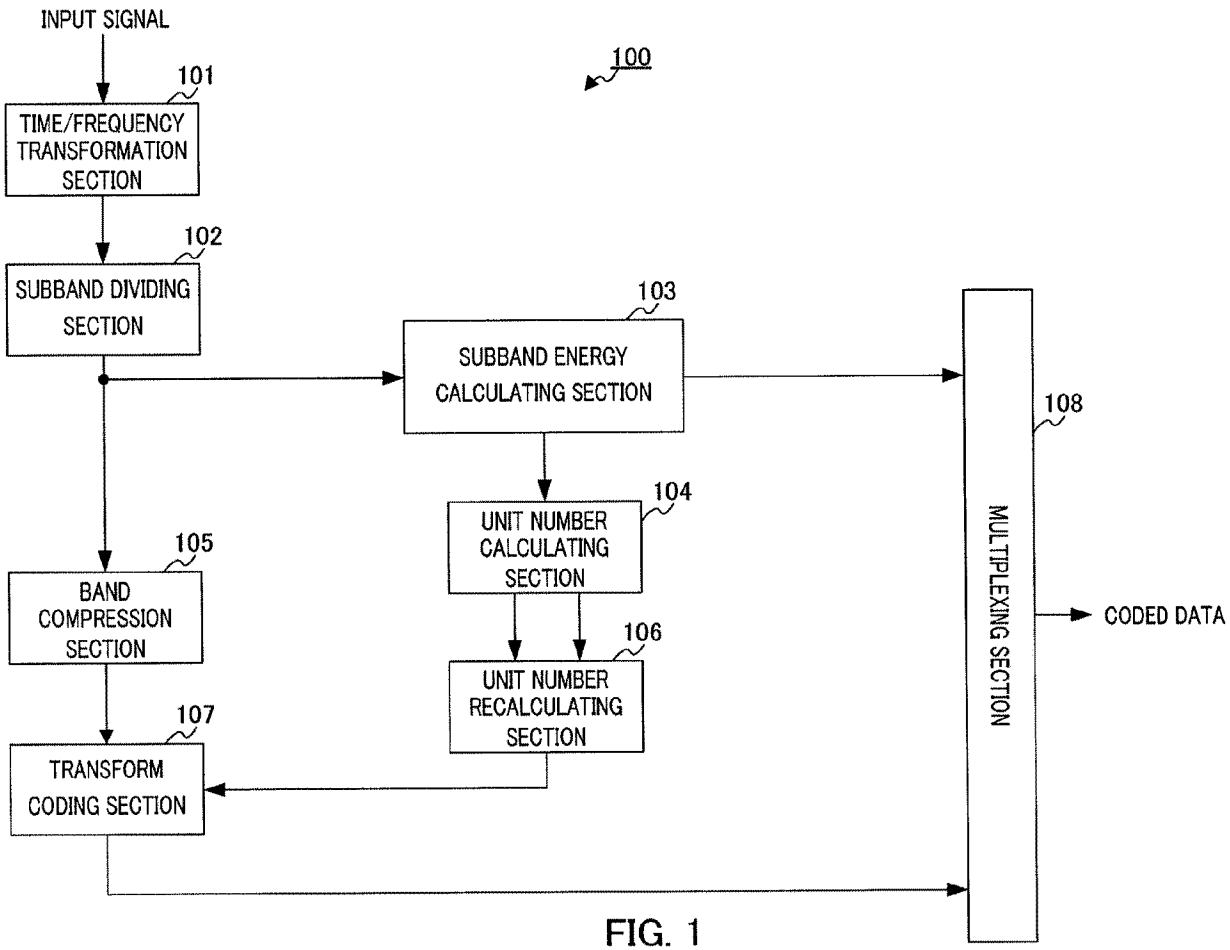
FIG. 1 is a block diagram illustrating a configuration of a speech/audio coding apparatus according to Embodiments 1, 3 and 5 of the present invention.

Hereinafter, embodiments of the present invention will be described in detail with reference to the accompanying drawings. Meanwhile, components among embodiments having the same function are assigned the same reference numerals and overlapping description will be omitted.

(Embodiment 1)

FIG. 1 is a block diagram illustrating a configuration of speech/audio coding apparatus 100 according to Embodiment 1 of the present invention. Hereinafter, the configuration of speech/audio coding apparatus 100 will be described using FIG. 1.

Time/frequency transformation section 101 acquires an input signal, transforms the acquired time-domain input signal to a frequency-domain signal and outputs the frequency-domain signal to subband dividing section 102 as an input signal spectrum. Note that in the embodiment, MDCT will be described as an example of time/frequency transformation, but orthogonal transformation such as FFT (Fast Fourier Transform) or DCT (Discrete Cosine Transform) may also be used.

Subband dividing section 102 divides the input signal spectrum outputted from time/frequency transformation section 101 into M subbands and outputs the subband spectrum to subband energy calculating section 103 and band compression section 105. With human perceptual characteristics taken into account, non-uniform division is generally performed so that the lower the band, the narrower the bandwidth becomes, and the higher the band, the broader the bandwidth becomes. The present embodiment will also be described based on this premise. Suppose that a subband length of an n-th subband is represented by W[n] and a subband spectrum vector is represented by Sn. Each Sn stores W[n] spectra. Suppose that there is a relationship of $W[k-1] \leq W[k]$. An example of the coding scheme that performs non-uniform division is ITU-T G.719. G.719 time/frequency transforms an input signal having a sampling rate of 48 kHz. After that, G.719 divides the spectrum into subbands at every 8 points in the frequency domain in the lowest band and divides the spectrum into subbands at every 32 points in the highest band. Note that G.719 is a coding scheme that can use many coded bits from 32 kbps to 128 kbps, but to further lower the bit rate, it is useful to increase the length of each subband and increase the subband length for high bands in particular.

Subband energy calculating section 103 calculates energy for each subband from the subband spectrum outputted from subband dividing section 102, outputs the quantized subband energy to unit number calculating section 104, and outputs subband energy coded data obtained by encoding the subband energy to multiplexing section 108. Here, suppose that the subband energy is the energy of a spectrum included in the subband expressed by the base 2 logarithm. A subband energy calculation equation is shown in following equation 1.

(Equation 1)

$$E[n] = \log 2\left(\sum_{i=1}^{w[n]} (sn[n][i] * sn[n][i])\right) \quad [1]$$

Here, n represents a subband number, E[n] represents subband energy of subband n, W[n] represents a subband length of subband n and Sn[i] represents an i-th spectrum of the n-th subband. Suppose that the subband length is registered beforehand in subband energy calculating section 103.

Unit number calculating section 104 calculates a provisional number of allocated bits to be allocated to a subband based on the quantized subband energy outputted from subband energy calculating section 103, and outputs the provisional number of allocated bits together with the calculated unit number to unit number recalculating section 106. As with subband energy calculating section 103, suppose that the subband length is registered beforehand in unit number calculating section 104. Basically, the greater the subband energy E[n], the more coded bits are allocated. However, coded bits are allocated on a unit basis and the number of bits per unit depends on the subband length. For this reason, it is necessary to make an optimal allocation including bit allocation in other subbands. Details of unit number calculating section 104 will be described later.

Band compression section 105 compresses each subband in an extended band using the subband spectrum outputted from subband dividing section 102 and outputs the subband on the low band side and a subband compressed spectrum including the compressed subband to transform coding section 107. It is an object of band compression to delete information on a spectrum position while leaving a main spectrum as a coding target and thereby reduce the number of coded bits required for transform coding. Details of band compression section 105 will be described later.

Unit number recalculating section 106 reallocates the bits reduced in the band-compressed subband to a low band outside the extended band based on the provisional number of allocated bits and the number of units outputted from unit number calculating section 104. Unit number recalculating section 106 reallocates the number of units based on the reallocated bit and outputs the number of reallocated units to transform coding section 107. Details of unit number recalculating section 106 will be described later.

Transform coding section 107 encodes the subband compressed spectrum outputted from band compression section 105 through transform coding and outputs the transform-coded data to multiplexing section 108. As the transform coding scheme, a transform coding scheme such as FPC, AVQ or LVQ is used. Transform coding section 107 encodes the inputted subband compressed spectrum using coded bits determined by the number of reallocated units outputted from unit number recalculating section 106. As the number of reallocated units increases, it is possible to increase the number of pulses for approximating the spectrum or make the amplitude value thereof more accurate. Whether to increase the number of pulses or improve the amplitude accuracy is determined using distortion between the input spectrum to be encoded and the decoded spectrum as a reference.

Multiplexing section 108 multiplexes the subband energy coded data outputted from subband energy calculating section 103 and the transform-coded data outputted from transform coding section 107 and outputs the multiplexed data as coded data.

Here, the unit number allocation method in unit number calculating section 104 shown in FIG. 1 will be described with a specific example. First, unit number calculating section 104 calculates the number of bits allocated to each subband based on the subband energy outputted from subband energy calculating section 103. Hereinafter, the number of calculated bits is called a "provisional number of allocated bits." For example, when the total number of coded bits given to encode a spectrum fine structure is 320 bits, and the total subband energy of respective subbands calculated according to equation 1 and then quantized is 160, since 320/160=2.0, the energy of each subband multiplied by 2.0 can be assumed to be the provisional number of allocated bits.

Next, unit number calculating section 104 determines bits to be actually allocated to each subband (hereinafter referred to as "number of allocated bits"), but since coded bits are allocated on a unit basis in transform coding, the provisional number of allocated bits cannot be assumed as the number of allocated bits without change. For example, when the provisional number of allocated bits is 30 and one unit is 7 bits, if the number of allocated bits does not exceed the provisional number of allocated bits, the number of units is 4, the number of allocated bits is 28, and 2 bits are redundant bits with respect to the provisional number of allocated bits.

Thus, when the number of allocated bits is sequentially calculated for each subband, excess or deficiency may occur in the number of coded bits at a point in time at which calculation is completed for all subbands. For this reason, it is necessary to a find a way to efficiently allocate coded bits. For example, bits may be allocated without excess or deficiency by adding redundant bits generated in a certain subband to the provisional number of allocated bits in the next subband.

This will be described using a specific example. Here, a case where only position information of a pulse for approximating a spectrum is encoded will be described as an example, and suppose that the position information is simply added every time the number of pulses encoded increases. For example, if the subband length is 32, since 32 is 2 raised to the power of 5, a minimum of 5 bits is necessary to make all spectral positions within the subband the coding targets. That is, one unit in this subband is 5 bits.

If the provisional number of allocated bits calculated from the energy of a subband is 33, the number of units allocated is 6, the number of allocated bits is 30, and the redundant bits are 3 bits. However, if two redundant bits are generated in the preceding subband, two redundant bits of the preceding subband are added to the provisional number of allocated bits of this subband and the provisional number of allocated bits becomes 35. As a result, the number of units is 7 and the number of allocated bits is 35. That is, redundant bits are 0 bits. By sequentially repeating this process for all subbands, efficient unit allocation is possible.

Next, a band compression method in band compression section 105 shown in FIG. 1 will be described. As the band compression method, a case will be described as an example where combinations of two samples are created in order from the low band side of the subband subject to band compression and a sample of each combination having a greater absolute value amplitude is left.

Figure 2A:
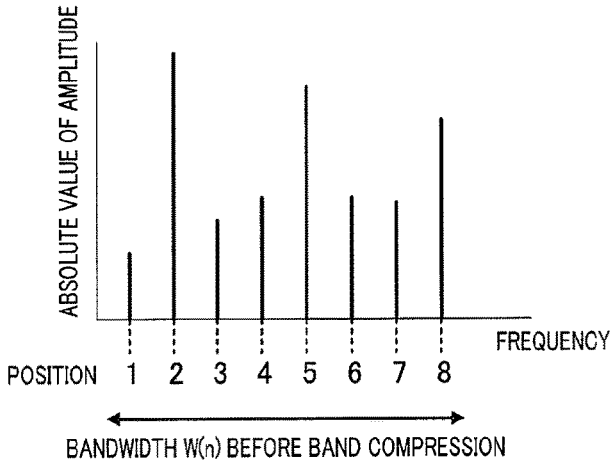
FIGS. 2A to 2C are diagrams provided for describing band compression.
Figure 2B:
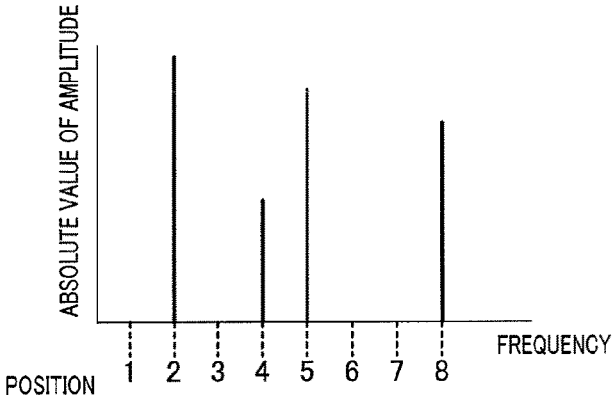
Figure 2C:
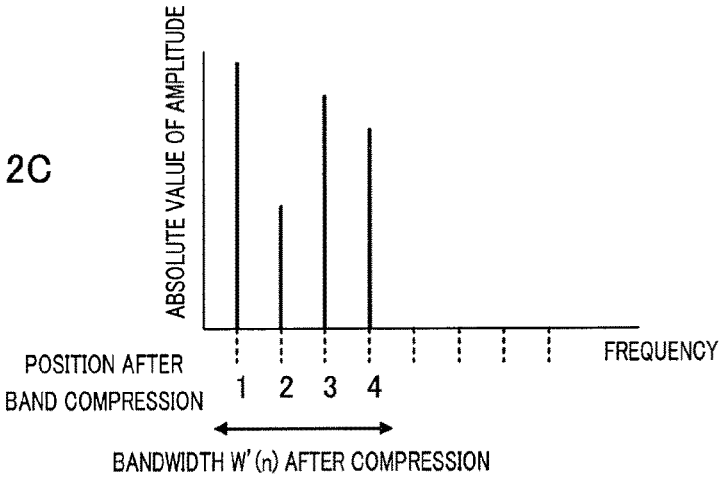

FIGS. 2A to 2C are diagrams provided for describing band compression. FIGS. 2A to 2C illustrate a situation in which the subband subject to band compression n is extracted in an extended band, and suppose the subband length is W(n), the horizontal axis shows a frequency and the vertical axis shows an absolute value of amplitude of a spectrum.

FIG. 2A illustrates a subband spectrum before band compression. In this example, suppose that a bandwidth before band compression is W(n)=8. Band compression section 105 creates combinations of two samples in order from the low band side from subband spectra outputted from subband dividing section 102 and leaves a spectrum having a greater absolute value of amplitude of each combination. In the example in FIG. 2A, of a combination of spectra located at first and second positions, the second spectrum is selected and the first spectrum is discarded. Similarly, band compression section 105 selects a greater spectrum from a combination of third and fourth positions, a combination of fifth and sixth positions and a combination of seventh and eighth positions respectively. The selection results are as shown in FIG. 2B and four spectra at second, fourth, fifth and eighth positions are selected.

Next, band compression section 105 band-compresses the selected spectra. Band compression is performed by tightly arranging the selected spectra on the low band side in the frequency domain. As a result, the band-compressed subband spectra are expressed in FIG. 2C and the bandwidth after band compression becomes a half of the bandwidth before compression. When a case is also considered where the bandwidth before compression is an odd number, subband width W'(n) after band compression can be expressed by following equation 2.

[2]

$$W'(n)=(int)(W(n)/2)+W(n)\%2 \quad \text{(Equation2)}$$

In equation 2, (int) denotes a function that discards all digits to the right of the decimal point to make integer, % denotes an operator for calculating a remainder.

Thus, with each subband subject to band compression in the extended band, it is possible to reduce the bandwidth by half while leaving spectra having a greater absolute value of amplitude among combinations of two samples in order from the low band side.

Next, a unit number recalculation method in unit number recalculating section 106 shown in FIG. 1 will be described. Unit number recalculating section 106 is similar to unit number calculating section 104 in that it calculates the number of allocated bits so as to approximate to the provisional number of allocated bits, but it is different in that it keeps the number of units calculated in unit number calculating section 104 in the subband subject to band compression and that it reallocates the bits reduced in the subband subject to band compression to the low band.

In order to reallocate the bits reduced in the subband subject to band compression to the low band, unit number recalculating section 106 first confirms the number of allocated bits of the subband subject to band compression. Since the number of units is fixed and the subband length is reduced by band compression, the number of allocated bits can be reduced. Here, since a case has been described where the subband length is reduced by half through band compression, the number of bits per unit is reduced by 1. When the total number of units of the subband subject to band compression is 10, the number of bits can be reduced by 10.

By adding the bits that have been successfully reduced to the provisional number of allocated bits in the low-band subbands, more units can be allocated to the low-band subbands. Here, suppose that the reduced bits are added to the provisional number of allocated bits in the lowest subband for simplicity. As a result, the provisional number of allocated bits increases in the lowest band subband, and therefore the number of units allocated can be expected to increase.

Hereinafter, redundant bits generated in this subband are sequentially added to the provisional number of allocated bits in the subbands on the high-band side and units are reallocated. By repeating this up to the subband immediately before the subband subject to band compression, it is possible to reallocate units to all subbands after band compression.

Figure 3:
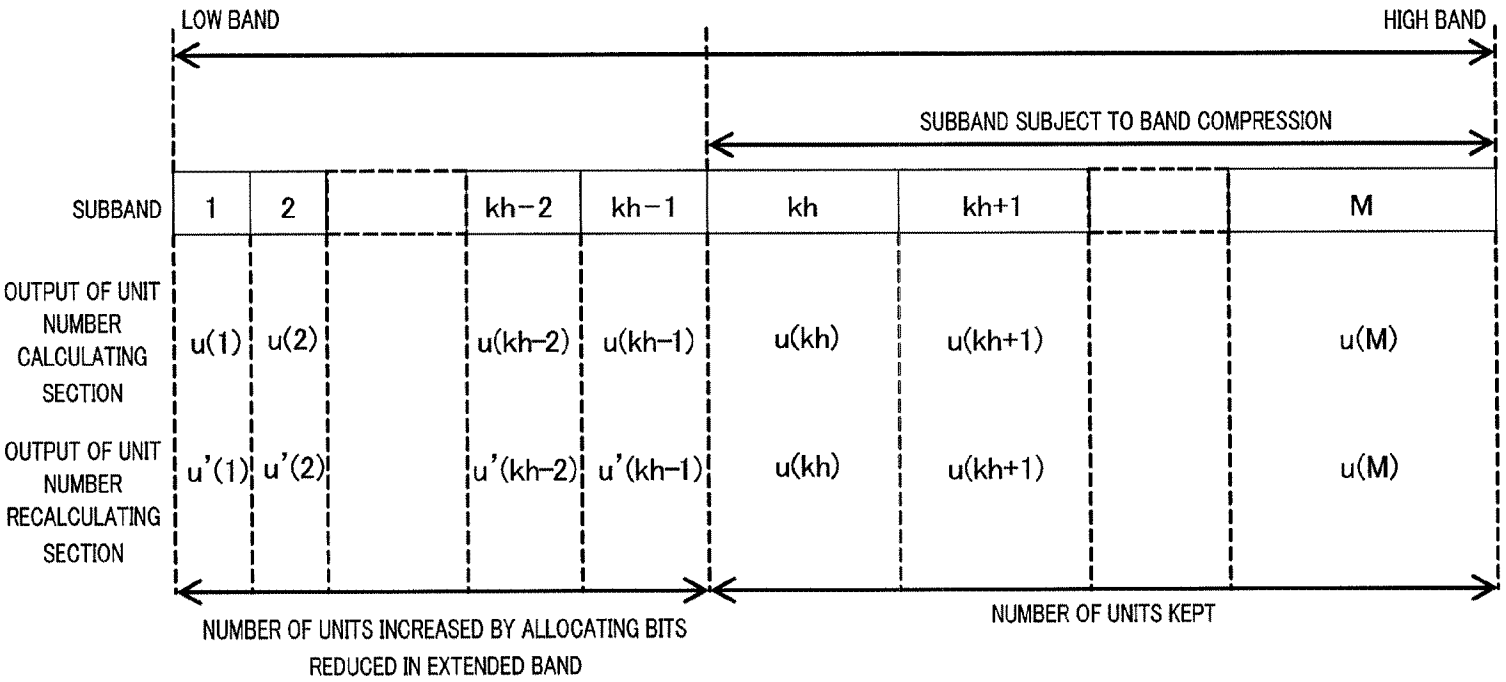
FIG. 3 is a diagram provided for describing operation of a unit number recalculating section.

FIG. 3 shows a diagram provided for describing operation of unit number recalculating section 106. The top row in FIG. 3 (row described as "subband") shows a subband division image. Suppose that a band is divided into subbands 1 to M, with subband 1 being a subband on the lowest band side and subband M being a subband on the highest band side. Suppose subbands 1 to (kh−1) correspond to the low band side not subject to band compression and subbands kh to M correspond to subbands subject to band compression.

The middle row (row described as "output of unit number calculating section") shows the number of units outputted from unit number calculating section 104. As the number of units, suppose u(k) is assigned to subband k by unit number calculating section 104.

Unit number recalculating section 106 uses u(k) calculated in unit number calculating section 104 without change for subband kh to subband M. This is intended to keep the number of pulses for approximating a spectrum even after compressing a bandwidth. The bandwidth is thereby compressed while keeping spectrum approximating performance in the band-compressed subbands, and it is thereby possible to reduce the number of coded bits and convert the reduced bits to redundant bits.

In FIG. 3, the bottom row (row described as "output of unit number recalculating section") shows an output image of unit number recalculating section 106. Since unit number recalculating section 106 uses the output of unit number calculating section 104 as is for subband kh to subband M, the number of units is kept to u(k). Unit number recalculating section 106 can use redundant bits for subbands on the low band side and newly calculate u'(k). This allows the coding accuracy of low band spectra which are perceptually important to be increased, and can thereby improve total sound quality.

An example has been described above where all the bits reduced in the band-compressed subbands are added to the provisional number of allocated bits of the subband on the lowest band side, but it is also possible to uniformly allocate the number of reduced allocated bits to subbands whose number of allocated bits is not calculated yet and add them to the provisional number of allocated bits of these subbands. Alternatively, more bits may be added to a subband having greater subband energy. Processing need not always be performed in ascending order from the low band side to the high band side.

With the above-described configuration, speech/audio coding apparatus 100 band-compresses each subband in the extended band, reduces coded bits, reallocates the reduced coded bits to the low band as redundant bits, and can thereby improve sound quality.

Figure 4:
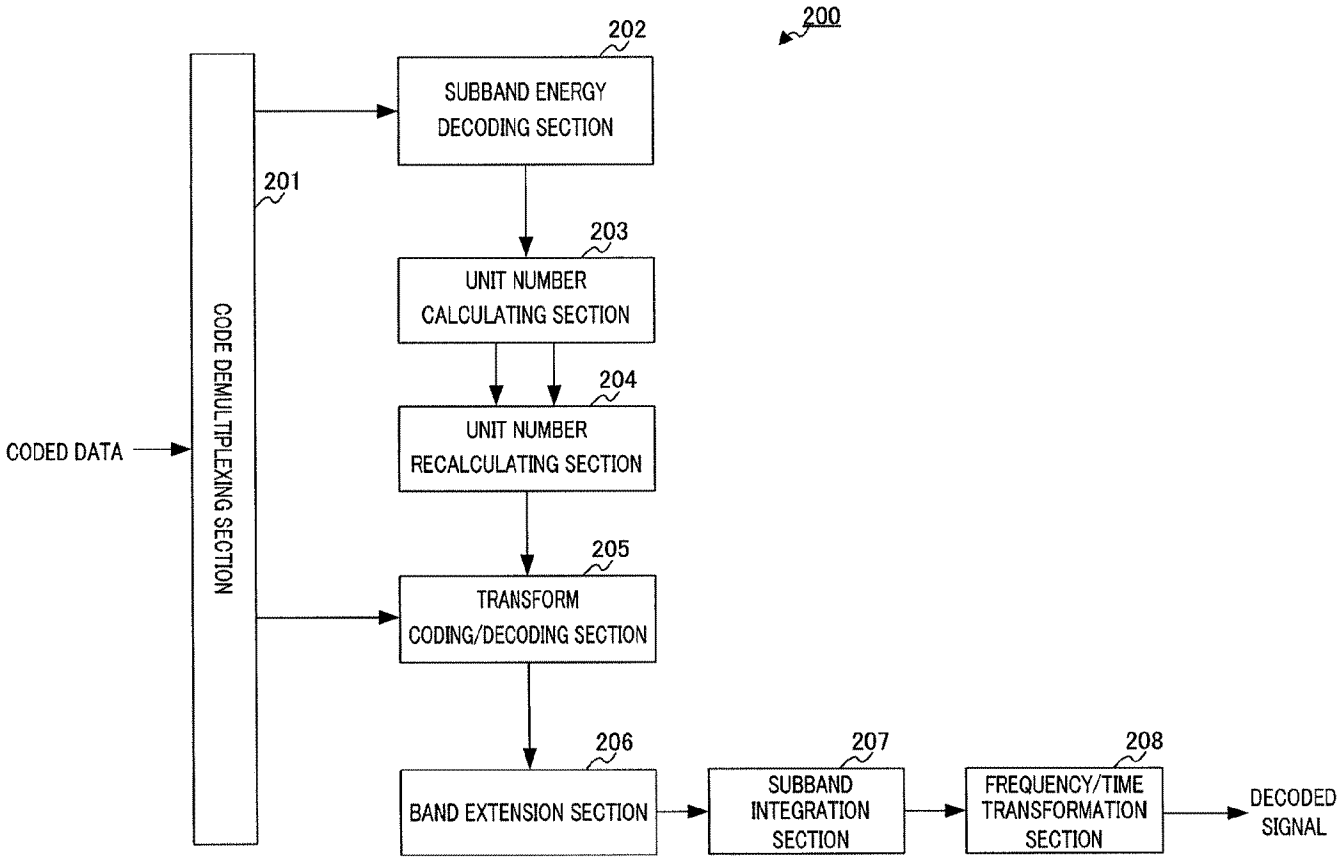
FIG. 4 is a block diagram illustrating a configuration of a speech/audio decoding apparatus according to Embodiments 1, 3 and 5 of the present invention.

FIG. 4 is a block diagram illustrating a configuration of speech/audio decoding apparatus 200 according to Embodiment 1 of the present invention. The number of units or the number of bits per unit is not transmitted, and therefore the number needs to be calculated on the decoding apparatus side. For this reason, speech/audio decoding apparatus 200 is provided with a unit number calculating section and a unit number recalculating section as in the case of the coding apparatus. The configuration of speech/audio decoding apparatus 200 will be described below using FIG. 4.

Code demultiplexing section 201 receives coded data, demultiplexes the received coded data into subband energy coded data and transform-coded data, outputs the subband energy coded data to subband energy decoding section 202 and transform-coded data to transform coding/decoding section 205.

Subband energy decoding section 202 decodes the subband energy coded data outputted from code demultiplexing section 201 and outputs the quantized subband energy obtained by the decoding to unit number calculating section 203.

Unit number calculating section 203 calculates the provisional number of allocated bits and the number of units using the quantized subband energy outputted from subband energy decoding section 202 and outputs the calculated provisional number of allocated bits and number of units to unit number recalculating section 204. Note that unit number calculating section 203 is identical to unit number calculating section 104 of speech/audio coding apparatus 100, and therefore detailed description thereof will be omitted.

Unit number recalculating section 204 calculates the number of reallocated units based on the provisional number of allocated bits and the number of units outputted from unit number calculating section 203 and outputs the calculated number of reallocated units to transform coding/decoding section 205. Unit number recalculating section 204 is identical to unit number recalculating section 106 of speech/audio coding apparatus 100, and therefore detailed description thereof will be omitted.

Transform coding/decoding section 205 outputs a decoding result for each subband to band extension section 206 as a subband compressed spectrum based on the transform-coded data outputted from code demultiplexing section 201 and the number of reallocated units outputted from unit number recalculating section 204. Transform coding/decoding section 205 acquires the number of coded bits required for coding from the number of reallocated units and decodes the transform-coded data.

In a subband not subject to band compression among the subband compressed spectra outputted from transform coding/decoding section 205, band extension section 206 outputs the subband compressed spectrum as is to subband integration section 207 as a subband spectrum. In a subband subject to band compression among the subband compressed spectra outputted from transform coding/decoding section 205, band extension section 206 extends the subband compressed spectrum to a width of the subband and outputs the extended spectrum to subband integration section 207 as a subband spectrum.

According to the present embodiment, band compression section 105 of speech/audio coding apparatus 100 performs band compression using a method of creating combinations of two samples in order from the low band side of the band-compressed subband and leaving a sample of a greater absolute value of amplitude of each combination, and therefore band extension section 206 stores every other decoded spectrum at an even-numbered address or odd-numbered address, and can thereby obtain a spectrum extended to an original bandwidth (bandwidth prior to compression). In this case, a position deviation of the decoded subband spectrum is a maximum of one sample. Details of band extension section 206 will be described later.

Subband integration section 207 tightly arranges the subband spectra outputted from band extension section 206 from the low band side, integrates them into one vector and outputs the integrated vector to frequency/time transformation section 208 as a decoded signal spectrum.

Frequency/time transformation section 208 transforms the decoded signal spectrum which is a frequency-domain signal outputted from subband integration section 207 into a time-domain signal and outputs the decoded signal.

Figure 5:
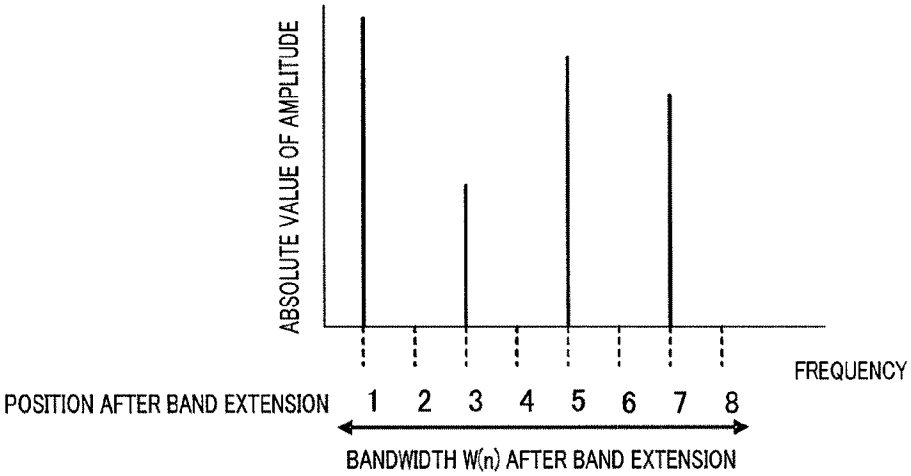
FIG. 5 is a diagram provided for describing band extension.

Next, the band extension method in band extension section 206 shown in FIG. 4 will be described. FIG. 5 shows a diagram provided for describing band extension. However, in FIG. 5 as in the case of FIG. 2, suppose the subband length is W(n), the horizontal axis shows a frequency, the vertical axis shows an absolute value of amplitude of a spectrum, and a case will be described where the subband compressed spectrum shown in FIG. 2C is extended.

A subband compressed spectrum located at position 1 after band compression existed at position 1 or position 2 before compression. Similarly, a subband compressed spectrum located at position 2 after band compression existed at position 3 or position 4 before compression. Similarly, subband compressed spectra existing at position 3 and position 4 after band compression existed at position 5 or position 6, and position 7 or position 8 respectively.

Since band extension section 206 cannot know at which position a spectrum after band compression existed before band compression, band extension section 206 extends the spectrum after band compression by placing the spectrum at any one position. In the example in FIG. 5, the subband compressed spectrum at position 1 after band compression is placed at position 1 after extension, the subband compressed spectrum at position 2 after band compression is placed at position 3 after extension, and so on, that is, subband compressed spectra are sequentially placed at odd-numbered addresses. As a result, only the spectrum located at spectrum position 5 after extension is placed at a correct position and other spectra are placed at positions deviated by one sample.

With the above-described configuration, coded data can be decoded by speech/audio decoding apparatus 200.

In this way, according to Embodiment 1, speech/audio coding apparatus 100 creates combinations of two samples of subband spectra in order from the low band side in a subband subject to band compression, selects a spectrum having a greater absolute value of amplitude of each combination, tightly arranges the selected spectra by on the low band side in the frequency domain, and can thereby thin out perceptually unimportant spectra and compress the band. Furthermore, it is thereby possible to reduce the number of allocated bits necessary for transform coding of a spectrum.

According to Embodiment 1, the number of allocated bits reduced in the subband subject to band compression is reallocated for transform coding of spectra in a lower band than the extended band, and it is thereby possible to express perceptually important spectra more accurately and thereby improve sound quality.

Figure 6:
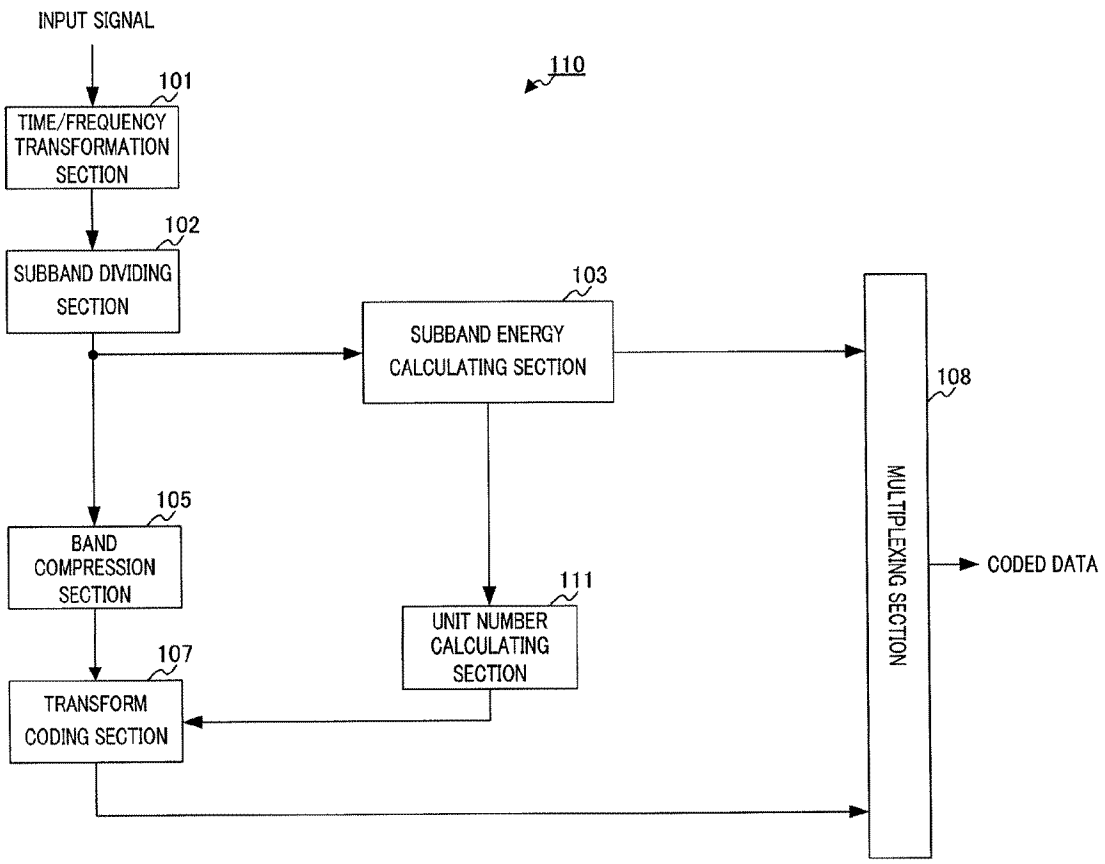
FIG. 6 is a block diagram illustrating another configuration of the speech/audio coding apparatus according to Embodiment 1 of the present invention.

A case has been described in the present embodiment where in speech/audio coding apparatus 100, unit number calculating section 104 calculates the number of units and unit number recalculating section 106 calculates the number of reallocated units. However, in the present invention, as shown in FIG. 6, the functions of unit number calculating section 104 and unit number recalculating section 106 as speech/audio coding apparatus 110 may be integrated into unit number calculating section 111.

Figure 7:
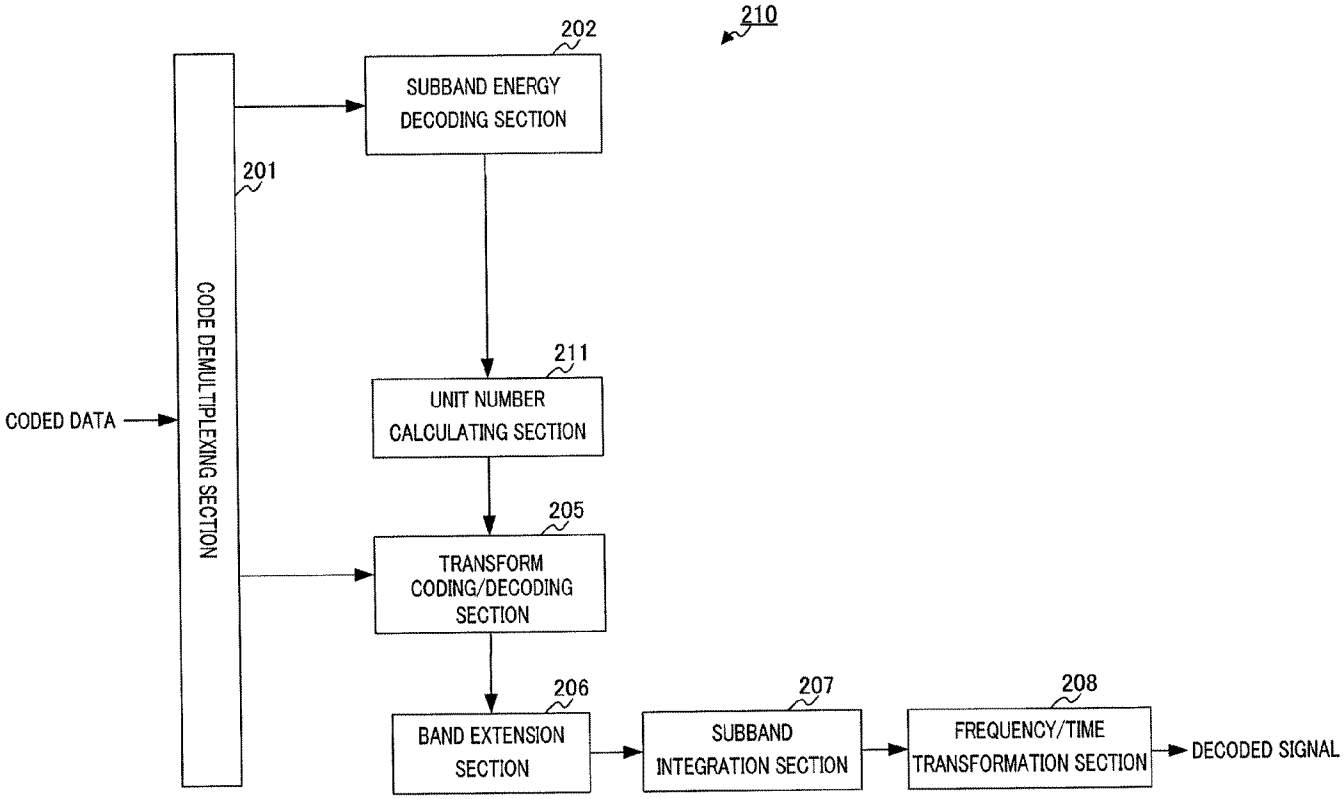
FIG. 7 is a block diagram illustrating another configuration of the speech/audio decoding apparatus according to Embodiment 1 of the present invention.

A case has been described in the present embodiment where in speech/audio decoding apparatus 200, unit number calculating section 203 calculates the number of units and unit number recalculating section 204 calculates the number of reallocated units. However, in the present invention, as shown in FIG. 7, the functions of unit number calculating section 203 and unit number recalculating section 204 as speech/audio decoding apparatus 210 may be integrated into unit number calculating section 211.

A case has been described in the present embodiment where as a band compression method, combinations of two samples are created in order from the low band side of a subband subject to band compression and a sample having a greater absolute value of amplitude of each combination is left, but other band compression methods may also be used. For example, without being limited to combinations of two samples, combinations of three samples or more may be created and a sample having the largest absolute value of amplitude of each combination may be left. In this case, it is possible to increase the number of bits that can be reduced by band compression.

Moreover, the higher the band, the more samples may be combined. Instead of creating combinations in order from the low band side, combinations may also be created in order from the high band side.

(Embodiment 2)

Figure 8:
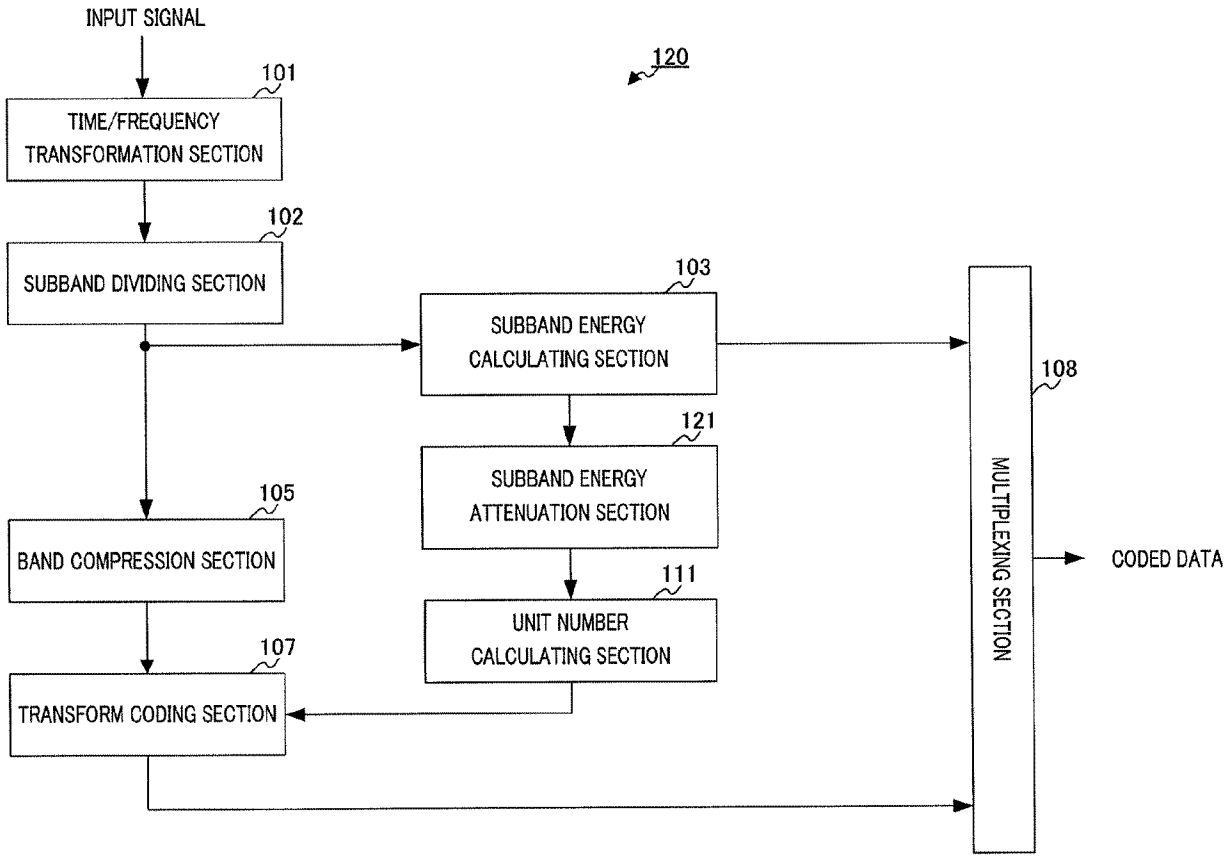
FIG. 8 is a block diagram illustrating a configuration of a speech/audio coding apparatus according to Embodiment 2 of the present invention.

FIG. 8 is a block diagram illustrating a configuration of speech/audio coding apparatus 120 according to Embodiment 2 of the present invention. The configuration of speech/audio coding apparatus 120 will be described below using FIG. 8. FIG. 8 is different from FIG. 1 in that unit number recalculating section 106 is deleted, unit number calculating section 104 is changed to unit number calculating section 111 and subband energy attenuation section 121 is added.

Subband energy attenuation section 121 causes to attenuate, subband energy of the subband subject to band compression of the quantized subband energy outputted from subband energy calculating section 103 and outputs the attenuated subband energy to unit number calculating section 111.

The reason that the subband energy of the subband subject to band compression is caused to attenuate will be described here. If the subband energy is not caused to attenuate, as described in Embodiment 1, provisional allocation bits are determined by unit number calculating section 111 based on this subband energy, but if the band is reduced, for example, by half through band compression, the number of bits of a unit is reduced by one bit, and therefore redundant bits are generated. However, since unit number recalculating section 106 is not present, the redundant bits cannot always be appropriately reallocated from a subband on the high band side to a subband on the low band side and may be wasted.

Thus, subband energy attenuation section 121 causes the subband energy to attenuate with respect to the subband subject to band compression and thereby prevents useless redundant bits from being generated. However, even when the subband length is reduced by half through band compression, principal spectra are left, and therefore cutting the subband energy by half may result in excessive attenuation. Thus, subband energy attenuation section 121 may, for example, multiply the subband energy by a fixed rate such as 0.8 or subtract a constant, for example, 3.0 from the subband energy.

Figure 9:
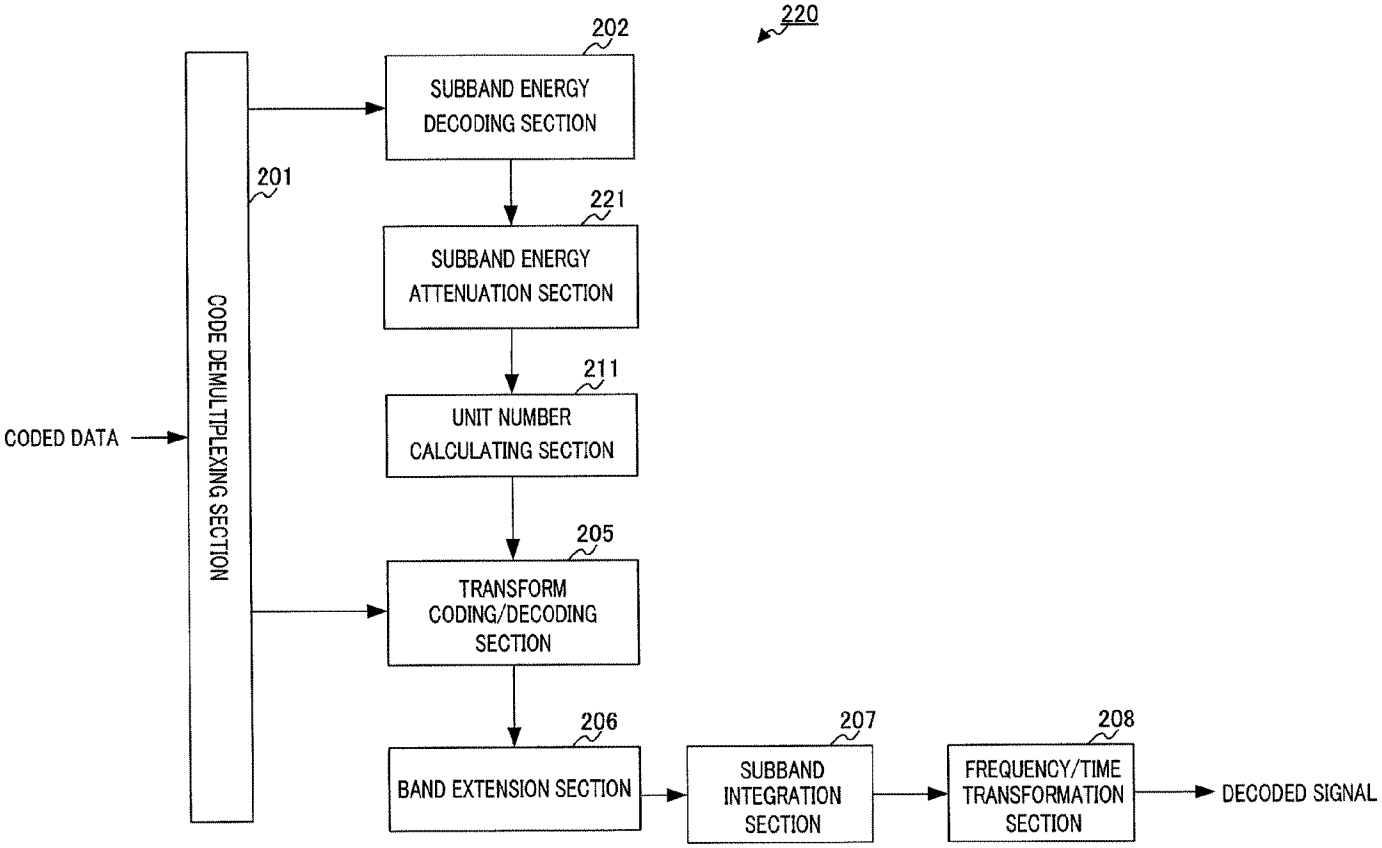
FIG. 9 is a block diagram illustrating a configuration of a speech/audio decoding apparatus according to Embodiment 2 of the present invention.

FIG. 9 is a block diagram illustrating a configuration of speech/audio decoding apparatus 220 according to Embodiment 2 of the present invention. Hereinafter, the configuration of speech/audio coding apparatus 220 will be described using FIG. 9. FIG. 9 is different from FIG. 4 in that unit number recalculating section 204 is deleted, unit number calculating section 104 is changed to unit number calculating section 211, and subband energy attenuation section 221 is added.

Subband energy attenuation section 221 causes to attenuate, the subband energy of the subband subject to band compression of the subband energy outputted from subband energy decoding section 202 and outputs the attenuated subband energy to unit number calculating section 211. However, subband energy attenuation section 221 performs attenuation under the same condition as that of subband energy attenuation section 121 of speech/audio coding apparatus 120.

Thus, according to Embodiment 2, speech/audio coding apparatus 120 causes the subband energy of the subband subject to band compression to attenuate so that provisional allocation bits have the same values as those on the coding side.

(Embodiment 3)

According to Embodiment 1, the spectrum position of the subband subject to band compression after extension may change from that of the subband before band compression. Thus, for at least a spectrum whose absolute value of amplitude that has a great influence on perception within a subband is a maximum spectrum (hereinafter referred to as "spectrum with maximum amplitude"), the spectrum position may be adapted so as not to change before and after band compression.

A case will be described in Embodiment 3 of the present invention where the position of a spectrum with maximum amplitude after decoding in the subband subject to band compression is corrected.

The configurations of a speech/audio coding apparatus and a speech/audio decoding apparatus according to Embodiment 3 of the present invention are similar to the configurations shown in Embodiment 1 in FIG. 1 and FIG. 4, and are different only in the functions of band compression section 105 and band extension section 206, and therefore only different functions will be described with reference to FIG. 1 and FIG. 4.

Furthermore, the configurations will be described below using FIG. 2A, FIG. 2B and FIG. 5.

Referring to FIG. 1, band compression section 105 searches for a spectrum with maximum amplitude from the subband spectra outputted from subband dividing section 102. Band compression section 105 calculates position correction information that is assumed to be 0 if the spectrum with maximum amplitude is located at an odd-numbered address and assumed to be 1 if the spectrum with maximum amplitude is located at an even-numbered address and outputs the position correction information to transform coding section 107. In FIG. 2B, since the spectrum with maximum amplitude is a spectrum located at position 2 (even-numbered address), band compression section 105 calculates the position correction information as 1. The calculated position correction information is encoded by transform coding section 107 and transmitted to speech/audio decoding apparatus 200.

Figure 10:
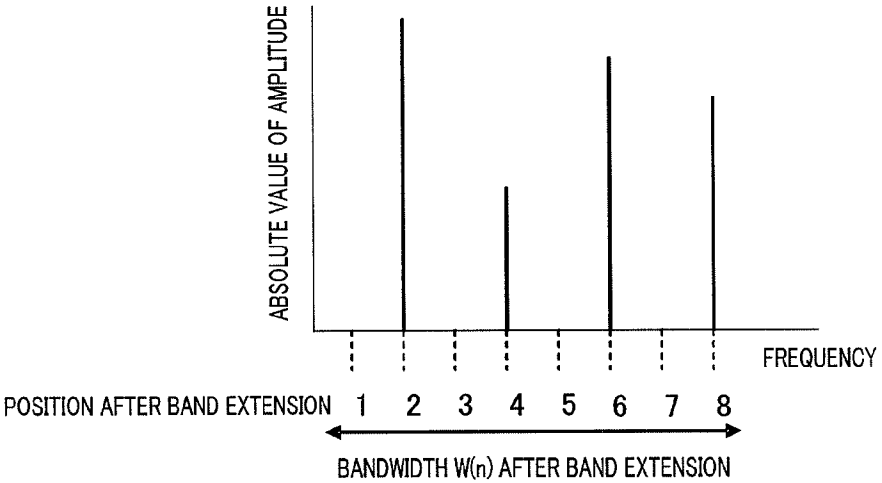
FIG. 10 is a diagram illustrating a band extended based on position correction information.

Referring to FIG. 4, in the subband not subject to band compression of the subband compressed spectra outputted from transform coding/decoding section 205, band extension section 206 assumes the subband compressed spectrum as a subband spectrum as is and outputs the subband compressed spectrum to subband integration section 207. In the subband subject to band compression of the subband compressed spectra outputted from transform coding/decoding section 205, band extension section 206 arranges the spectrum with maximum amplitude based on the decoded position correction information, extends the remaining subband compressed spectra to the subband width and outputs the extended subband compressed spectrum to subband integration section 207 as subband spectra. Here, since the position correction information is 1, the spectrum with maximum amplitude is arranged at an even-numbered address. This result is shown in FIG. 10. It can be seen from a comparison with FIG. 2A that the spectrum with maximum amplitude located at position 2 is disposed at a correct position. Note that spectra other than the spectrum with maximum amplitude may be shifted by a maximum of one sample.

Thus, by arranging a spectrum with maximum amplitude based on position correction information, it is possible to keep the spectrum position of the spectrum with maximum amplitude before and after band compression.

Note that when a band is reduced by half, one bit needs to be allocated to position correction information, and therefore when the number of units is 5, the final number of bits to be reduced is 4 from the five reduced bits and one bit corresponding to the position correction information to be increased. When a band is compressed to ¼ and the number of units is 5, the final number of bits to be reduced is 8 from the ten reduced bits and two bits corresponding to the position correction information to be increased.

Thus, according to Embodiment 3, speech/audio coding apparatus 100 calculates 0 if the spectrum with maximum amplitude of the subband subject to band compression is located at an odd-numbered address and calculates 1 if the spectrum with maximum amplitude of the subband subject to band compression is located at an even-numbered address, transmits the calculation result to speech/audio decoding apparatus 200, and speech/audio decoding apparatus 200 arranges the spectrum with maximum amplitude based on the position correction information, and can thereby keep the spectrum position of the spectrum with maximum amplitude which has a great influence on perception within a subband before and after band compression.

In the present embodiment, such calculation has been described that position correction information is assumed to be 0 if the spectrum with maximum amplitude is located at an odd-numbered address and assumed to be 1 if the spectrum with maximum amplitude is located at an even-numbered address, but the present invention is not limited to this. For example, the position correction information may be assumed to be 1 if the spectrum with maximum amplitude is located at an odd-numbered address and assumed to be 0 if the spectrum with maximum amplitude is located at an even-numbered address. When the subband subject to band compression is compressed to ⅓, ¼ or the like, position correction information associated therewith is calculated.

(Embodiment 4)

A case has been described in Embodiment 1 where as a method of compressing a band, combinations of two samples are created in order from the low band side of a subband subject to band compression and a sample having a greater absolute value of amplitude of each combination is left. However, in a case where a spectrum having the next highest amplitude after the spectrum with maximum amplitude (hereinafter referred to as "next highest spectrum") is adjacent to the spectrum with maximum amplitude, the next highest spectrum may be excluded from coding targets. It is confirmed from an observation that there are stochastically many cases in an extended band where a next highest spectrum is adjacent to a spectrum with maximum amplitude.

Thus, Embodiment 4 of the present invention will describe a case where an arrangement of spectra of a subband subject to band compression is changed according to a predetermined procedure (hereinafter referred to as "interleaving") so that the spectrum with maximum amplitude and the next highest spectrum are not adjacent to each other.

Figure 11:
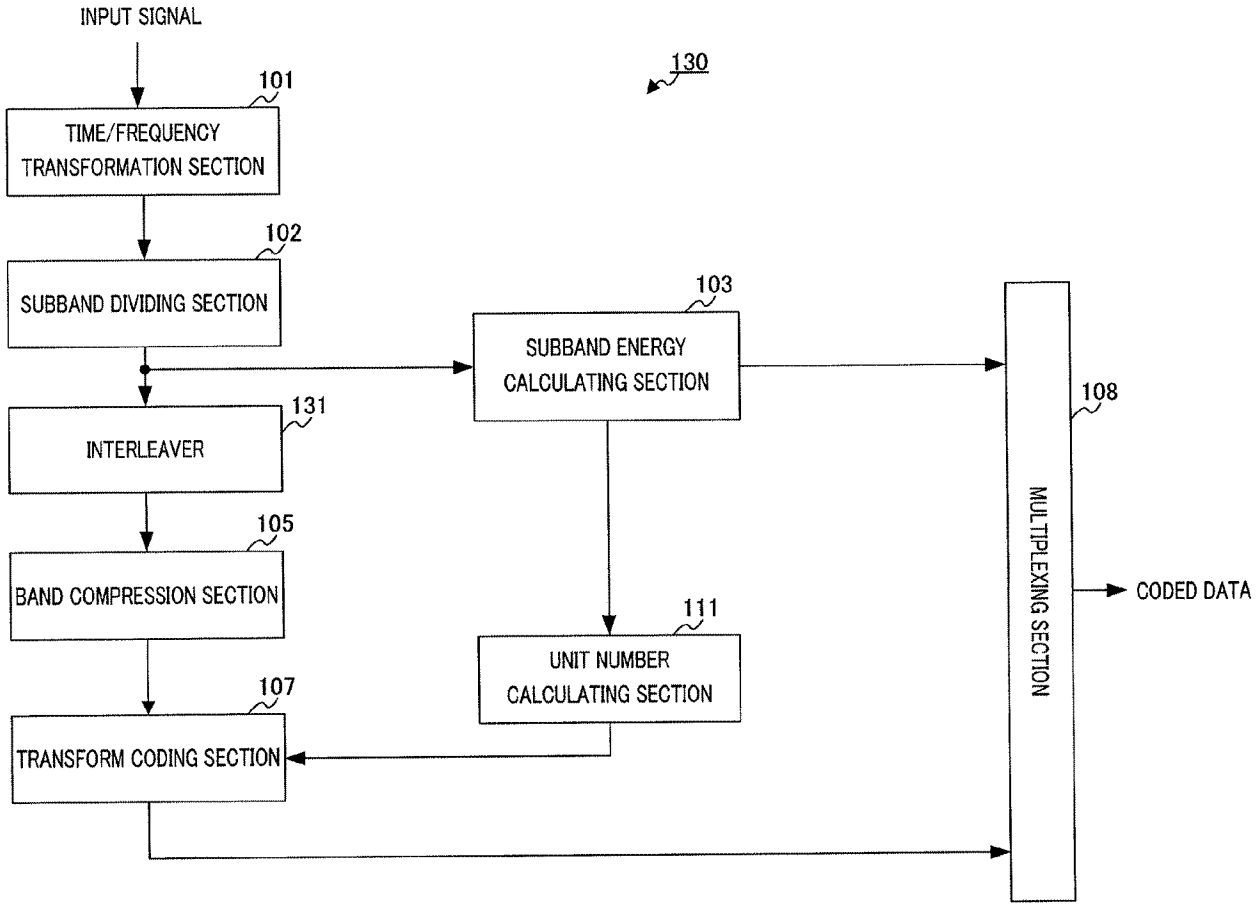
FIG. 11 is a block diagram illustrating a configuration of a speech/audio coding apparatus according to Embodiment 4 of the present invention.

FIG. 11 is a block diagram illustrating a configuration of speech/audio coding apparatus 130 according to Embodiment 4 of the present invention. Hereinafter, the configuration of speech/audio coding apparatus 130 will be described using FIG. 11. However, FIG. 11 is different from FIG. 6 in that interleaver 131 is added.

Interleaver 131 interleaves the arrangement of subband spectra outputted from subband dividing section 102 and outputs the interleaved subband spectra to band compression section 105.

FIGS. 12A to 12D show a diagram provided for describing interleaving. FIGS. 12A to 12D show a situation in which a subband n subject to band compression is extracted, and suppose that the subband length is represented by W(n), the horizontal axis shows a frequency, and the vertical axis shows an absolute value of amplitude of a spectrum.

Figure 12B:
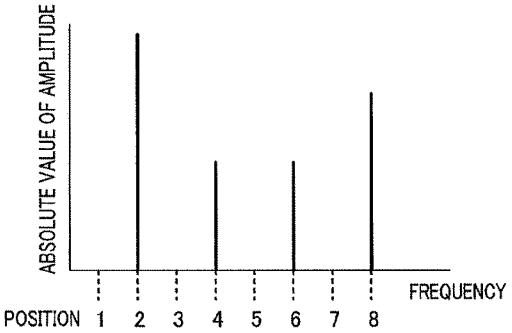
FIGS. 12A to 12D are diagrams provided for describing interleaving.
Figure 12A:
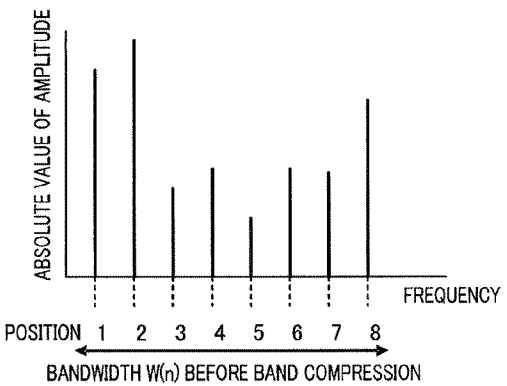

FIG. 12A shows a spectrum before band compression, and suppose that the spectrum at position 2 is a spectrum with maximum amplitude and the spectrum at position 1 is the next highest spectrum. Here, if a spectrum is selected using the method shown in Embodiment 1, the spectrum at position 2 is selected as shown in FIG. 12B and the next highest spectrum at position 1 is excluded from the coding targets.

Figure 12D:
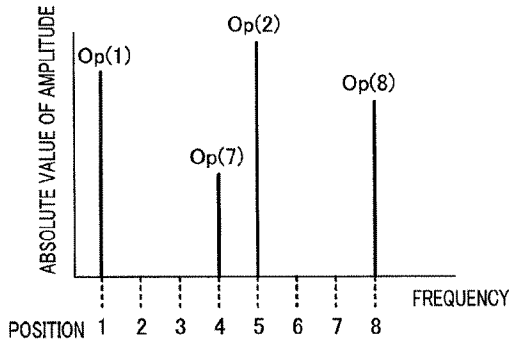
Figure 12C:
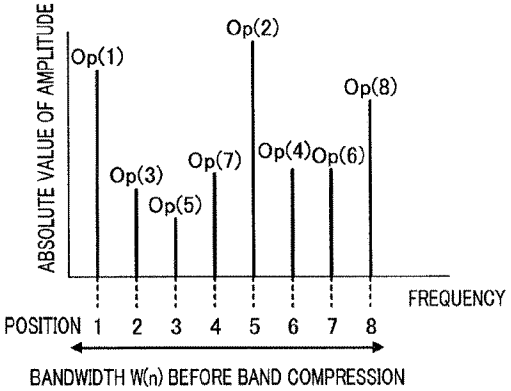

FIG. 12C illustrates spectra after interleaving. More specifically, FIG. 12C illustrates a situation in which odd-numbered addresses are rearranged on the low band side of the spectra and even-numbered addresses are rearranged on the high band side of the spectra. Op(x) (x=1 to 8) in the figure indicates that the subband spectrum position before interleaving is x.

Thus, interleaver 131 interleaves the arrangement of spectra in subbands subject to band compression, whereby the position of the spectrum with maximum amplitude becomes 5, the position of the next highest spectrum becomes 1, and both spectra are separated from each other. For this reason, even when band compression is performed using the method shown in Embodiment 1, the spectrum with maximum amplitude and the next highest spectrum can be coding targets as shown in FIG. 12D. However, the shift in spectrum positions after decoding becomes a maximum of two samples in this example.

Figure 13:
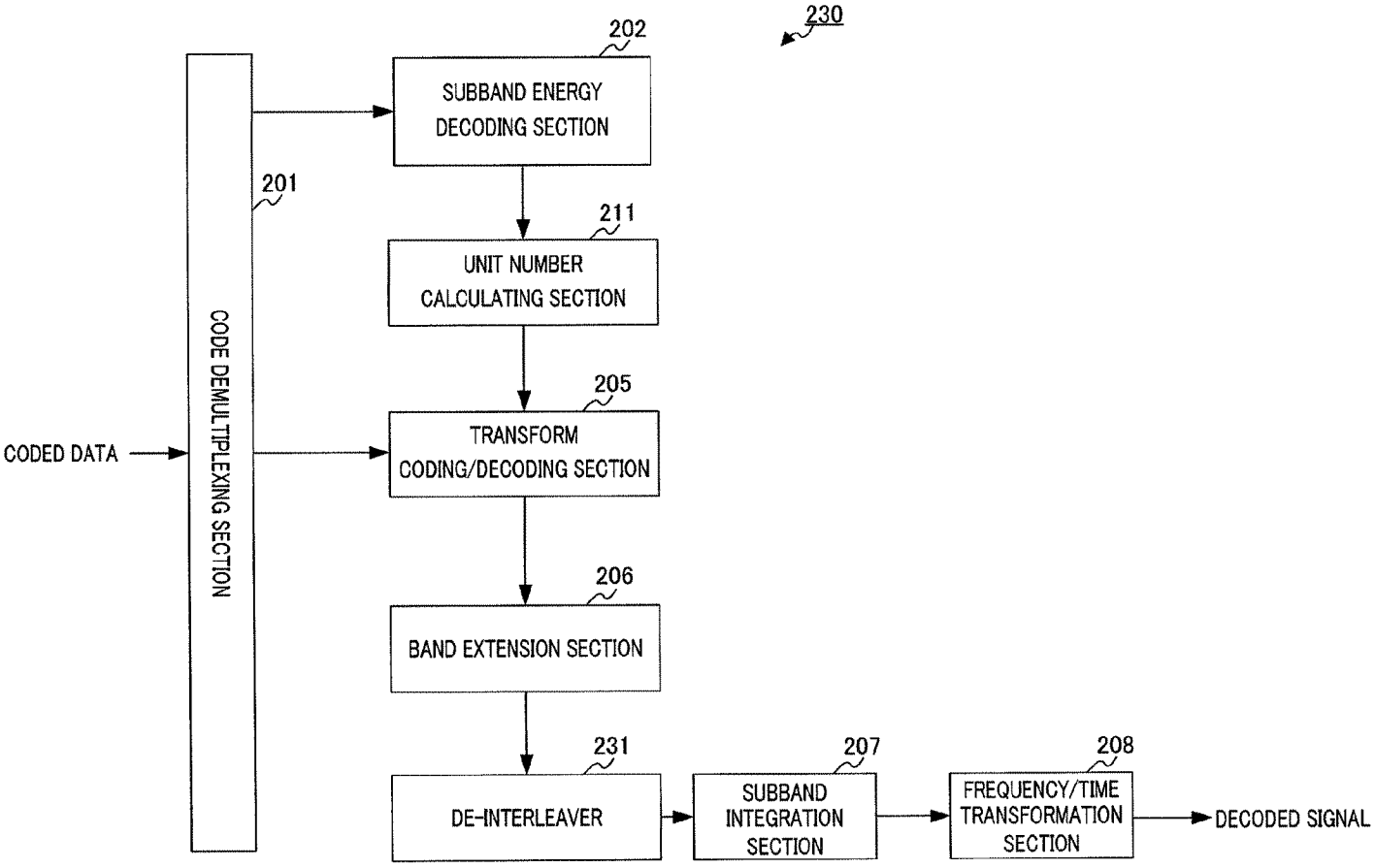
FIG. 13 is a block diagram illustrating a configuration of a speech/audio decoding apparatus according to Embodiment 4 of the present invention.

FIG. 13 is a block diagram illustrating a configuration of speech/audio decoding apparatus 230 according to Embodiment 4 of the present invention. Hereinafter, the configuration of speech/audio decoding apparatus 230 will be described using FIG. 13. However, FIG. 13 is different from FIG. 7 in that de-interleaver 231 is added.

In a subband subject to band compression of subband spectra separated for each subband outputted from band extension section 206, de-interleaver 231 de-interleaves the arrangement of subband spectra and outputs the subband spectra in the de-interleaved arrangement to subband integration section 207.

Thus, in Embodiment 4, speech/audio coding apparatus 130 interleaves the arrangement of spectra of a subband subject to band compression, performs band compression, and can thereby separate both spectra apart from each other even when the next highest spectrum is adjacent to the spectrum with maximum amplitude, and prevent the next highest spectrum from being excluded by band compression.

Note that the present embodiment can be optionally combined with one of Embodiments 1 to 3. In this regard, when the method of encoding position correction information with respect to a spectrum with maximum amplitude of Embodiment 3 is combined with the present embodiment, it is possible to accurately encode the position of the spectrum with maximum amplitude even when interleaving is performed.

(Embodiment 5)

Embodiment 4 has described a method for preventing, when interleaving causes the spectrum with maximum amplitude and the next highest spectrum to be adjacent to each other, the next highest spectrum from being excluded from the coding targets. In Embodiment 5 of the present invention, a description will be given of a method of preventing the next highest spectrum from being excluded from the coding targets by excluding the vicinity of a spectrum with maximum amplitude from band compression targets.

The configurations of a speech/audio coding apparatus and a speech/audio decoding apparatus according to Embodiment 5 of the present invention are similar to the configurations shown in Embodiment 1 in FIG. 1 and FIG. 4 and are only different in the functions of band compression section 105 and band extension section 206, and therefore different functions will be described using FIG. 1 and FIG. 4.

Referring to FIG. 1, band compression section 105 searches for a spectrum with maximum amplitude from subband spectra outputted from subband dividing section 102. When there are a plurality of spectra with maximum amplitude, a spectrum on the low band side is designated as a spectrum with maximum amplitude. Band compression section 105 extracts the searched spectrum with maximum amplitude and spectra in the vicinity thereof and designates them as spectra not subject to band compression, that is, some of subband compressed spectra. For example, suppose that one sample before and after the spectrum with maximum amplitude, that is, three samples are excluded from the band compression targets.

Band compression section 105 performs band compression on spectra closer to the low band side than the spectra not subject to band compression and arranges the band compression result from the low band side of the subband compressed spectra. Band compression section 105 arranges spectra not subject to band compression in continuation to the high band side of the subband compressed spectrum. Next, band compression section 105 performs band compression on spectra closer to the high band side than the spectra not subject to band compression and arranges the band compression result in continuation to the high band side of the subband compressed spectra.

Performing such processing by band compression section 105 makes it possible to obtain a subband compressed spectrum with the vicinity of the spectrum with maximum amplitude excluded from the band compression target and to make the spectrum with maximum amplitude and the next highest spectrum be the coding targets. If the position of the spectrum with maximum amplitude after extension is not precisely expressed, there is no information to be particularly sent to speech/audio decoding apparatus 200 regarding this band compression method.

Referring to FIG. 4, band extension section 206 searches for a maximum value of amplitude of the subband compressed spectrum outputted from transform coding/decoding section 205. When a plurality of maximum values of amplitude are detected, a spectrum on the low band side is designated as a spectrum with maximum amplitude as in the case of speech/audio coding apparatus 100. As a result, band extension section 206 designates spectra in the vicinity of the spectrum with maximum amplitude as spectra not subject to band compression. Here, the spectrum with maximum amplitude and one sample before and after the spectrum, that is, a total of three samples is extracted as spectra not subject to band compression.

Next, band extension section 206 extends subband compressed spectra closer to the low band side than the spectra not subject to band compression. Extension is performed by sequentially arranging low band side spectra of the subband compressed spectra at odd-numbered addresses and repeating the arrangement up to immediately before the spectra not subject to band compression. Band extension section 206 arranges the spectra not subject to band compression in continuation to the high band side of the extended subband spectra on the low band side. Next, band extension section 206 extends the subband compressed spectra closer to the high band side than the spectrum not subject to band compression and arranges the extended subband spectra on the high band side of the spectrum not subject to band compression.

Performing such processing by band extension section 206 makes it possible to extend subband compressed spectra with the vicinity of the spectrum with maximum amplitude excluded from the band compression targets.

Figure 14:
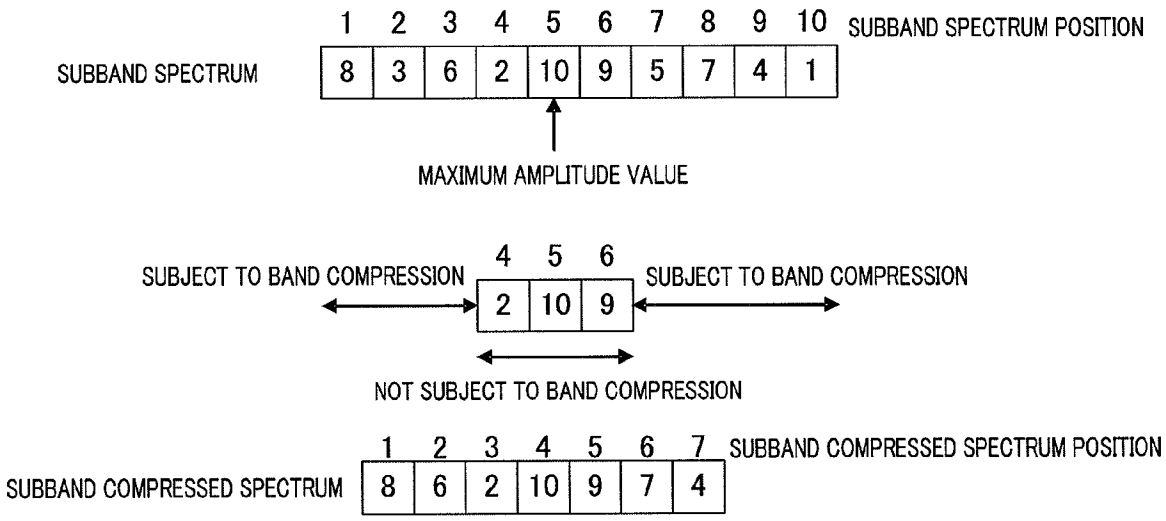
FIG. 14 is a diagram illustrating an example of band compression.

Next, a band compression method by aforementioned band compression section 105 will be described. FIG. 14 illustrates an example of band compression. Here, suppose the subband length is 10 and values of amplitude are 8, 3, 6, 2, 10, 9, 5, 7, 4 and 1 from the low band side.

Band compression section 105 first searches for a spectrum with maximum amplitude of subband spectra and extracts a spectrum with maximum amplitude and one sample before and after the spectrum with maximum amplitude, a total of three samples as spectra not subject to band compression. In this example, since a spectrum at position 5 is a maximum, spectra at positions 4, 5 and 6 are spectra not subject to band compression. That is, spectra at positions 1, 2 and 3 on the low band side and spectra at positions 7, 8, 9 and 10 on the high band side are spectra subject to band compression. As a result, spectra at positions 1 and 3 are selected, spectra at positions 4, 5 and 6 which are other than band compression targets are arranged in continuation thereto, spectra at positions 8 and 10 are selected in continuation thereto, and a subband compressed spectrum is thereby formed as shown in FIG. 14.

Figure 15:
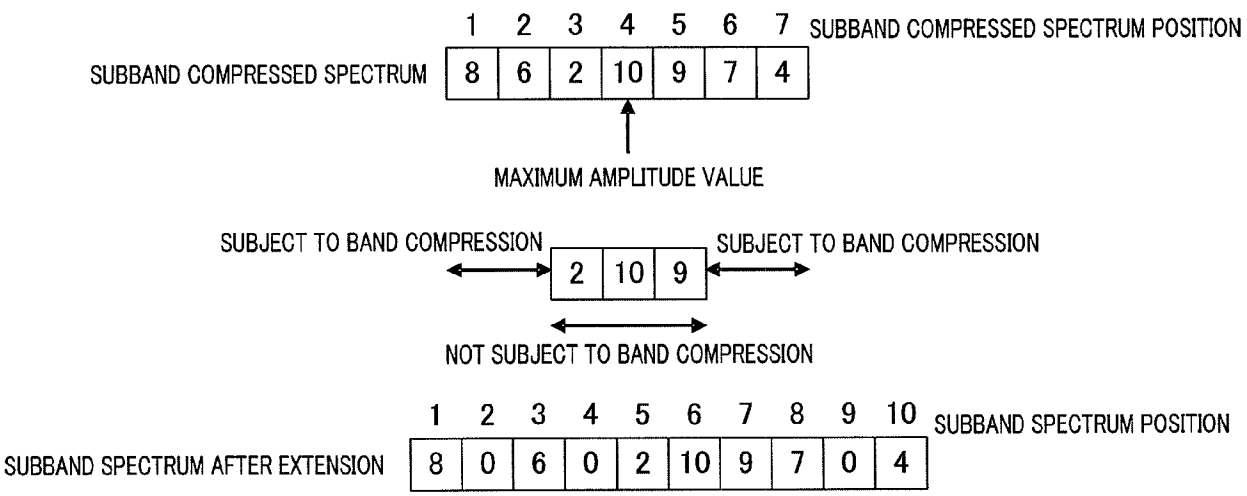
FIG. 15 is a diagram illustrating an example of band extension.

Next, the band extension method by aforementioned band extension section 206 will be described. FIG. 15 illustrates an example of band extension. Band extension section 206 searches for a maximum value of amplitude of a subband compressed spectrum. In this example, a spectrum at position 4 is a spectrum with maximum amplitude, and therefore spectra at positions 3, 4 and 5 are spectra not subject to band compression. That is, it can be seen that spectra at positions 1 and 2 on the low band side and spectra at positions 6 and 7 on the high band side are band compressed spectra.

Band extension section 206 arranges the subband compressed spectra at positions 1 and 2 at positions 1 and 3 of subband spectra respectively. Next, band extension section 206 arranges the spectra not subject to band compression at positions 5, 6 and 7 of the subband spectra in continuation thereto. Furthermore, band extension section 206 arranges the subband compressed spectra at positions 6 and 7 at positions 8 and 10 of the subband spectra. With such a procedure, it is possible to extend a subband compressed spectrum band-compressed by excluding the spectrum with maximum amplitude and the vicinity thereof from band compression targets.

Thus, according to Embodiment 5, speech/audio coding apparatus 100 excludes a spectrum with maximum amplitude and spectra in the vicinity thereof in a subband subject to band compression from band compression targets and band-compresses other spectra, and can thereby prevent, even when the next highest spectrum is adjacent to the spectrum with maximum amplitude, the next highest spectrum from being excluded by band compression.

In the present embodiment, the position of the spectrum with maximum amplitude after extension may not be an accurate position, but itis possible to arrange the spectrum with maximum amplitude at an accurate position by encoding and transmitting the position correction information described in Embodiment 2.

(Embodiment 6)

Generally, it is often the case that a perceptually important spectrum has large amplitude and is generated consecutively at substantially the same frequency for a long period of time which is a predetermined time or longer. The vowel in human speech has this feature, and this feature can be observed in many cases with a high band generated by musical instruments other than speech though not comparable with the vowel. Taking advantage of this feature, by extracting subjectively important spectra in a preceding frame and exclusively encoding only bands peripheral to the spectrum as coding targets in the current frame, it is possible to encode the perceptually important spectra efficiently.

In the subband spectrum which is the original signal, the coded bit amount of the spectrum that has been stably outputted for several frames may fluctuate frame by frame along with the fluctuation of subband energy, causing a phenomenon that coding succeeds or fails frame by frame. In this case, clarity of decoded speech may degrade and speech becomes noisy.

Thus, in Embodiment 6 of the present invention, a description will be given of a configuration whereby more efficient coding can be realized by not assigning all spectra of a subband in an extended band as coding targets but assigning only peripheral bands of a perceptually important spectrum as coding targets.

Figure 16:
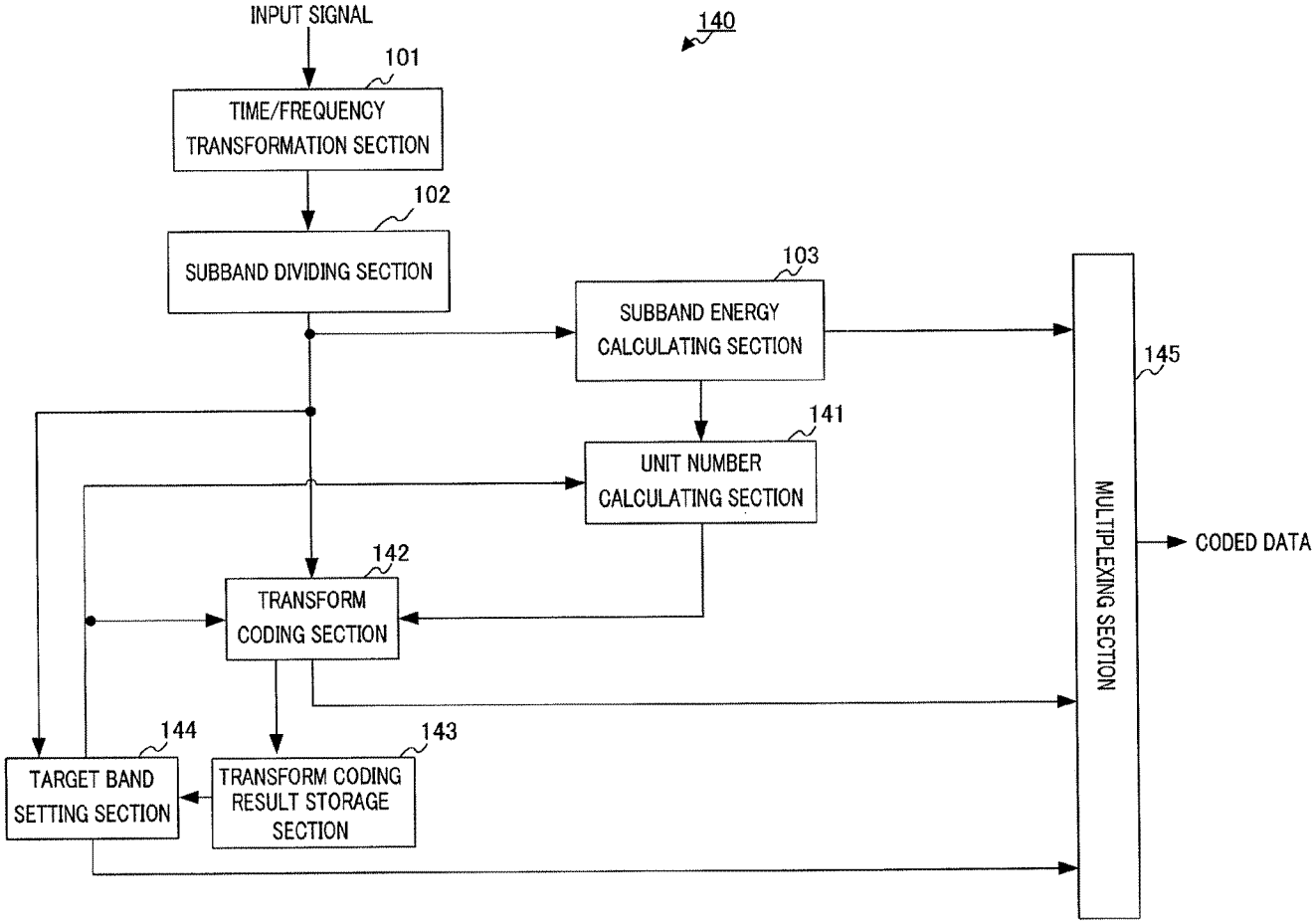
FIG. 16 is a block diagram illustrating a configuration of a speech/audio coding apparatus according to Embodiment 6 of the present invention.

FIG. 16 is a block diagram illustrating a configuration of speech/audio coding apparatus 140 according to Embodiment 6 of the present invention. Hereinafter, the configuration of speech/audio coding apparatus 140 will be described using FIG. 16. However, FIG. 16 is different from FIG. 1 in that unit number recalculating section 106 and band compression section 105 are deleted, unit number calculating section 104 is changed to unit number calculating section 141, transform coding section 107 is changed to transform coding section 142, multiplexing section 108 is changed to multiplexing section 145 and transform coding result storage section 143 and target band setting section 144 are added.

Unit number calculating section 141 calculates the provisional number of allocated bits which are allocated to each subband based on subband energy outputted from subband energy calculating section 103. Unit number calculating section 141 acquires a subband length of a coding target band of transform coding based on band limited subband information outputted from target band setting section 144 which will be described later. Since the number of units can be calculated from the acquired subband length, unit number calculating section 141 calculates the number of coded bits so as to approximate to the provisional number of allocated bits. Unit number calculating section 141 outputs information equivalent to the calculated coded bit amount to transform coding section 142 as the number of units. Bits are basically allocated in such a way that the greater the subband energy E[n], the more bits are allocated. However, bits are allocated on a unit basis and the number of bits required for the unit depends on the subband length. That is, even when the provisional number of allocated bits is the same, if the subband length is small, the number of bits necessary for the unit is small, and more units can be used. When more units can be used, more spectra can be encoded or the accuracy of amplitude can be increased.

Transform coding section 142 encodes the subband spectrum outputted from subband dividing section 102 through transform coding using the number of units outputted from unit number calculating section 141 and the band limited subband information outputted from target band setting section 144 which will be described later. The coded transform-coded data is outputted to multiplexing section 145. Transform coding section 142 decodes the transform-coded data and outputs the decoded spectrum to transform coding result storage section 143 as the decoded subband spectrum. At the time of coding, transform coding section 142 acquires a start spectrum position, end spectrum position and subband length or the like of a band to be encoded from the number of units outputted from unit number calculating section 141 and band limited subband information outputted from target band setting section 144, and performs transform coding. Hereinafter, a coding target subband shorter than a normal subband length set by target band setting section 144 will be called a "limited band" and when all spectra within a subband are coding targets, the spectra will be called an "entire band." Efficient coding is possible when a transform coding scheme such as FPC, AVQ or LVQ is used as a transform coding scheme. Note that spectra outside the limited band are excluded from coding targets, and so they are not encoded by transform coding. Here, amplitude of all spectra outside the limited band in decoded subband spectra is assumed to be 0.

Transform coding result storage section 143 stores decoded subband spectrum information outputted from transform coding section 142. Here, for simplicity of description, suppose that transform coding result storage section 143 stores only information on a spectrum with maximum amplitude in the subband (spectrum with a maximum absolute value of amplitude). Transform coding result storage section 143 assumes the stored spectrum position as spectrum information of the preceding frame and outputs the stored spectrum position to target band setting section 144 in a frame next to the stored frame. Note that when there are few bits and the number of units becomes 0 and when transform coding is not performed, the spectrum information is made to indicate that spectra are not stored. For example, spectrum information in the preceding frame may be set to −1.

Target band setting section 144 generates band limited subband information using the spectrum information on the preceding frame outputted from transform coding result storage section 143 and the subband spectrum outputted from subband dividing section 102, and outputs the band limited subband information to unit number calculating section 141 and transform coding section 142. The band limited subband information can be any information that at least identifies a start spectrum position and an end spectrum position of a band to be encoded and a subband length of the band to be encoded.

Target band setting section 144 outputs a band limitation flag indicating whether or not to band-limit a subband to multiplexing section 145. Here, suppose that band limitation is performed when the band limitation flag is 1 and the entire band is assumed to be a coding target when the band limitation flag is 0.

Multiplexing section 145 multiplexes the subband energy coded data outputted from subband energy calculating section 103, transform-coded data outputted from transform coding section 142 and the band limitation flag outputted from target band setting section 144 and outputs the multiplexing result as coded data.

With the above-described configuration, speech/audio coding apparatus 140 can generate band-limited coded data using the transform coding result in the preceding frame.

Next, the target band setting method by target band setting section 144 shown in FIG. 16 will be described.

Target band setting section 144 determines whether all spectra included in the subband to be encoded should be transform coding targets or spectra included in the band limited to the periphery of a perceptually important spectrum should be transform coding targets. The method of determining whether a spectrum is a perceptually important spectrum or not will be illustrated using a simple method below.

Among subband spectra, a spectrum with maximum amplitude is considered to be perceptually important. In the current frame, if a spectrum with maximum amplitude among subband spectra is within a band close to the spectrum with maximum amplitude in the preceding frame, it is possible to determine that the perceptually important spectrum is temporally continuous. In such a case, the coding range can be narrowed down to only a band peripheral to the perceptually important spectrum in the preceding frame.

For example, in a n-th subband, suppose the position of the perceptually important spectrum in the preceding frame is P[t−1, n]. When the band width after coding target limitation is WL[n], a start spectrum position of a coding target band after band limitation is expressed by P[t−1, n]−(int)(WL[n]/2) and an end spectrum position is expressed by P[t−1, n]+(int)(WL[n])/2). However, suppose WL[n] represents an odd number and (int) represents a process of discarding a decimal point here. Here, if subband length W[n] is 100 and WL[n] is 31, the minimum number of bits necessary to express the position of one spectrum can be reduced from 7 to 5.

WL[n] will be described as to be predetermined for each subband, but may also be variable according to the feature of the subband spectrum. For example, there is a method that increases WL[n] when subband energy is large and decreases WL[n] when a change in subband energy in frame t−1 and subband energy in frame t is small.

Although there is a relationship of $W[n-1] \leq W[n]$ at subband length W[n], limited bandwidth WL[n] need not be constrained by such a relationship. When the start spectrum position or end spectrum position of a limited band is outside the range of the original subband, the start spectrum position of the original subband may be the start spectrum position of the limited band or the end spectrum position of the original subband may be the end spectrum position of the limited band, and WL[n] may not be changed.

When the limited band is determined only by a transform coding result in a preceding frame, if a subjectively important spectrum moves to outside the limited band, there is a risk that the spectrum may not be encoded and some subjectively unimportant band may continue to be encoded as a limited band. However, as described in the present example, by determining whether or not a spectrum with maximum amplitude of a current subband exists in a limited band, it is possible to know whether or not any subjectively important spectrum exists outside the limited band. In that case, by assuming the entire band to be a coding target, it is possible to contribute to successive coding of subjectively important spectra.

A case has been described as an example where target band setting section 144 calculates a perceptually important band from the positions of spectra with maximum amplitude in the preceding frame and the current frame, but it is also possible to estimate a harmonic structure of a high band spectrum from a harmonic structure of a low band spectrum and calculate a perceptually important band. The harmonic structure is a structure in which low-band spectra are substantially uniformly spaced also on the high-band side. Therefore, it is possible to estimate the harmonic structure from the low-band spectrum and also estimate the harmonic structure in the high band. The estimated band periphery can also be encoded as a limited band. In this case, if the low-band spectra are encoded first and the high-band spectra are encoded using the coding result, it is possible to obtain identical band limited subband information between the speech/audio coding apparatus and the speech/audio decoding apparatus.

Next, a series of operations of aforementioned speech/audio coding apparatus 140 will be described.

Figure 17:
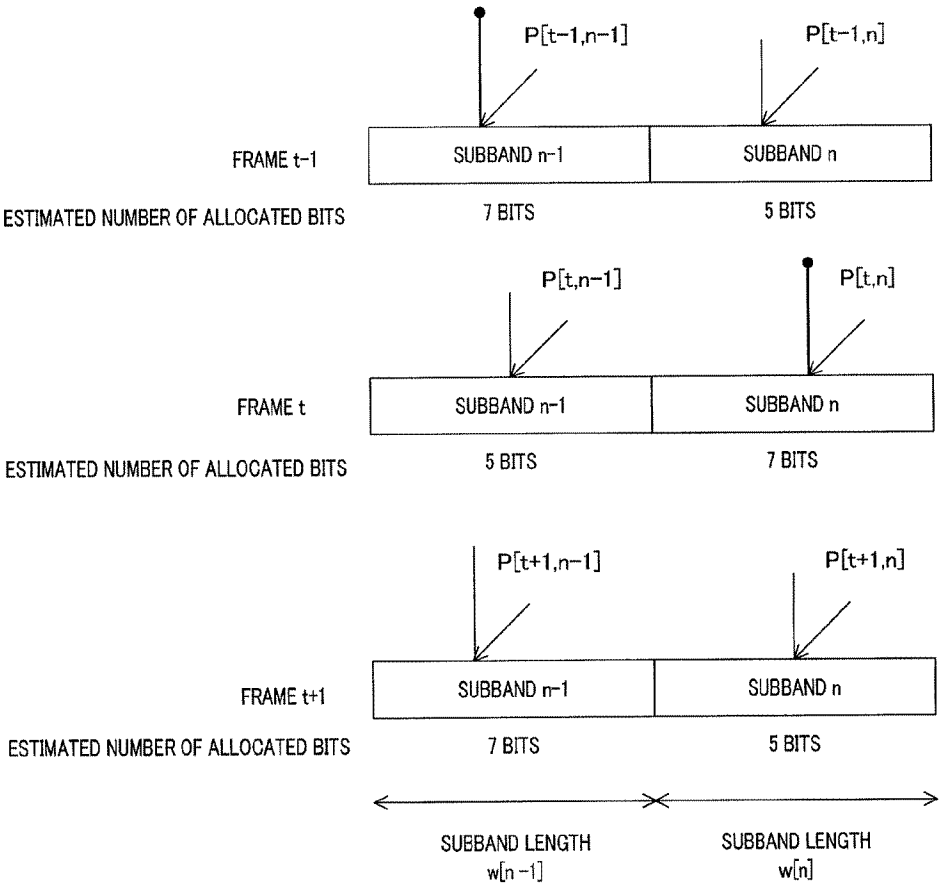
FIG. 17 is a diagram illustrating an example of transform coding not accompanied by band limitation.

First, coding of an extended band without band limitation will be described using FIG. 17. FIG. 17 shows two subbands: subband n−1 and subband n, and the horizontal axis shows a frequency and the vertical axis shows an absolute value of spectrum amplitude. The spectrum shows only a spectrum with maximum amplitude in each subband. Three temporally continuous frames t−1, t and t+1 are shown in order from the top. Suppose that the position of a spectrum with maximum amplitude of frame t, subband n−1 is represented by P[t, n−1].

Based on the subband energy calculated by subband energy calculating section 103, suppose the provisional number of allocated bits for frame t−1, subband n−1 is 7 and the provisional number of allocated bits for subband n is 5. Hereinafter, suppose that the provisional numbers of allocated bits are 5 bits and 7 bits for frame t, and 7 bits and 5 bits for frame t+1.

Suppose that subband length W[n−1] of subband n−1 is 100 and subband length W[n] is 110, and since both are smaller than 2 to the seventh power, the unit is made integer to be 7 bits for simplicity. In frame t−1, the provisional number of allocated bits of subband n−1 exceeds the unit, and therefore one spectrum can be encoded. Meanwhile, the provisional number of allocated bits of subband n does not exceed the unit, and therefore the spectrum is not encoded. In frame t, since the provisional numbers of allocated bits are 5 and 7, the spectrum is encoded only with subband n, and in frame t+1, the provisional numbers of allocated bits are 7 and 5, and therefore suppose the spectrum of subband n−1 is transform-coded.

In such a case, when a focus is placed on subband n−1, although spectra consecutively existed within a near band in an input spectrum, the provisional number of allocated bits is somehow not sufficient, and therefore the spectrum is not encoded in frame t, and not encoded temporally consecutively from t−1 to t+1. When continuity is missing as the case with the present example, clarity of a decoded signal deteriorates, giving an impression of noisiness.

Next, coding of a band-limited extended band will be described using FIG. 18.

Figure 18:
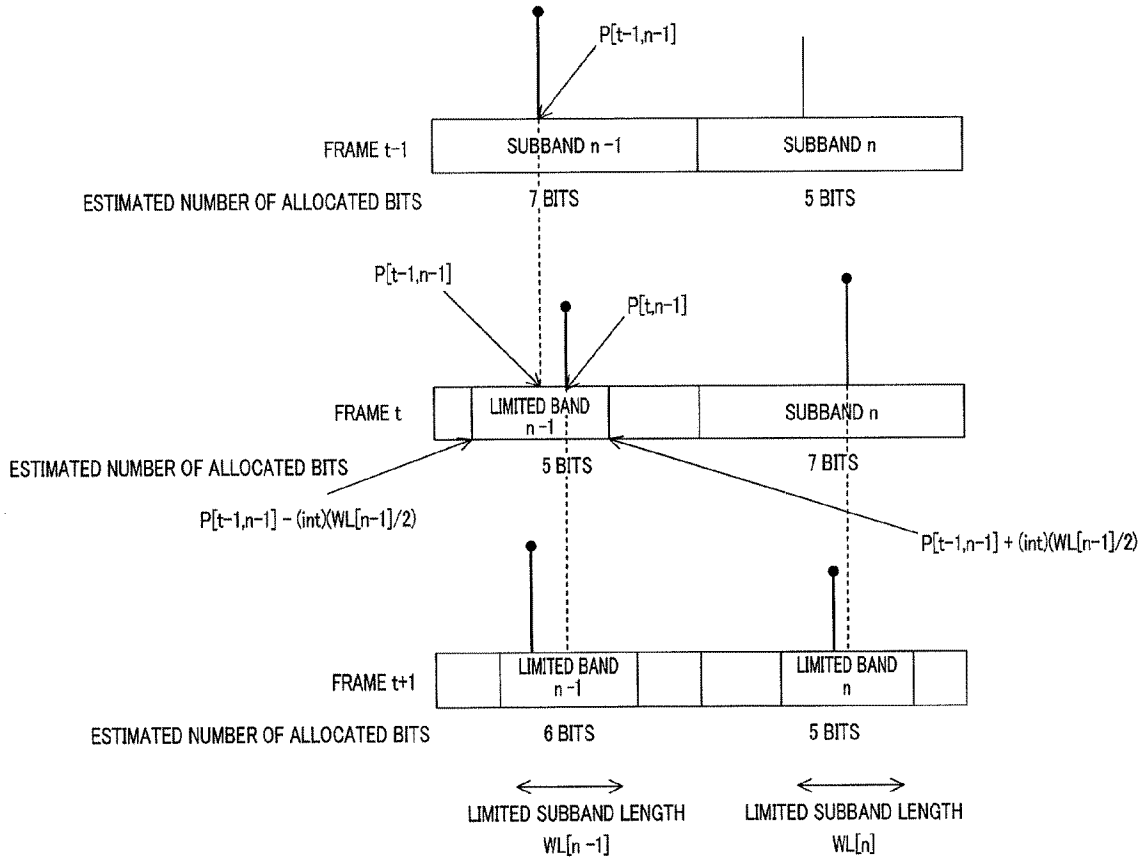
FIG. 18 is a diagram illustrating an example of transform coding accompanied by band limitation.

The basic configuration in FIG. 18 is similar to that in FIG. 17. Suppose that frame t−1 is completely identical to that in the example described in FIG. 17.

First, subband n in frame t will be described. Subband n in frame t−1 is not encoded by transform coding, and therefore in frame t, spectrum information of a preceding frame is outputted as −1 to target band setting section 144 from transform coding result storage section 143. Thus, in subband n in frame t, band limitation is not applied and all spectra within the subband are subjected to transform coding. The band limitation flag in subband n is set to 0. In the case of the present example, since the provisional number of allocated bits is 7, one spectrum is encoded.

Next, subband n−1 in frame t will be described. In frame t−1, transform coding is performed in subband n−1, and therefore spectrum information P[t−1, n−1] of the preceding frame is outputted from transform coding result storage section 143 to target band setting section 144. Target band setting section 144 sets a limited band to a range from P[t−1, n−1]−(int)(WL[n−1]/2) to P[t−1, n−1]+(int)(WL[n−1]/2). Next, spectrum with maximum amplitude P[t, n−1] is searched from among inputted subband spectra. In the present example, since P[t, n−1] exists within the limited band, the band limitation flag of subband n−1 is set to 1. Furthermore, target band setting section 144 outputs limited band start spectrum position P[t−1, n−1]−(int)(WL[n−1]/2), end spectrum position P[t−1, n−1]+(int)(WL[n−1]/2), and limited bandwidth WL[n−1] as band limited subband information.

Since the subband length is shortened from W[n−1] to WL[n−1] in unit number calculating section 141, the number of units is more likely to increase.

Transform coding section 142 encodes only spectra within the limited band specified by limited band subband information outputted from target band setting section 144 among subband spectra outputted from subband dividing section 102. If WL[n−1] is 31, since 31 is less than 2 to the fifth power, the unit is expressed by 5 for simplicity. In this example, since the provisional number of allocated bits is 5, one spectrum can be encoded. Hereinafter, in frame t+1, coding is also possible using a procedure similar to that in frame t.

It has been described above that by performing transform encoding exclusively on a band peripheral to an important spectrum, when a focus is placed on subband n−1, it is possible to perform coding continuously from frame t−1 to t+1 through transform coding.

Thus, since perceptually important spectra can be encoded temporally continuously, it is possible to obtain decoded speech of high clarity with less noisiness.

Figure 19:
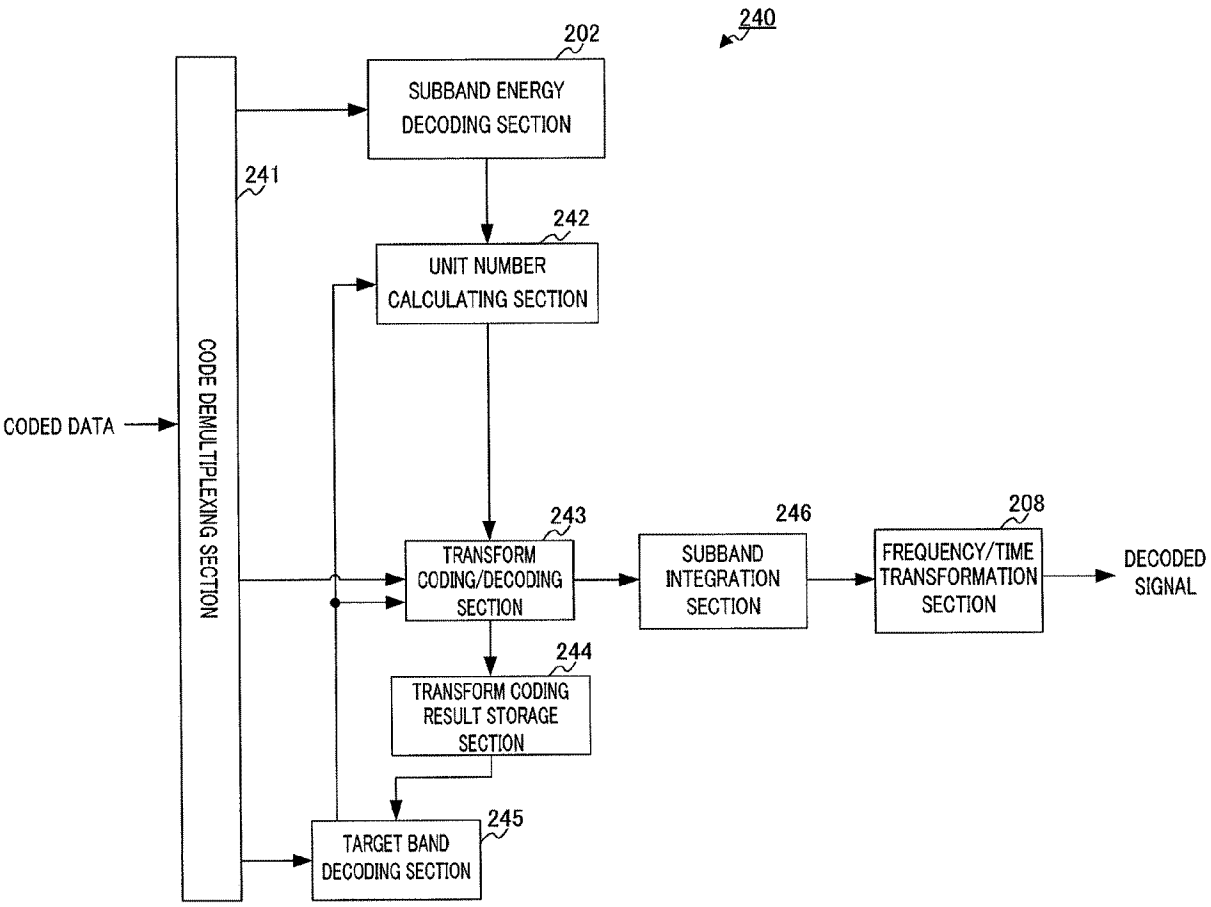
FIG. 19 is a block diagram illustrating a configuration of a speech/audio decoding apparatus according to Embodiment 6 of the present invention.

FIG. 19 is a block diagram illustrating a configuration of speech/audio decoding apparatus 240 according to Embodiment 6 of the present invention. Hereinafter, the configuration of speech/audio decoding apparatus 240 will be described using FIG. 19. However, FIG. 19 is different from FIG. 7 in that code demultiplexing section 201 is changed to code demultiplexing section 241, unit number calculating section 211 is changed to unit number calculating section 242, transform coding/decoding section 205 is changed to transform coding/decoding section 243, subband integration section 207 is changed to subband integration section 246, and transform coding result storage section 244 and target band decoding section 245 are added.

Code demultiplexing section 241 receives coded data and demultiplexes the received coded data into subband energy coded data, transform-coded data and a band limitation flag, outputs the subband energy coded data to subband energy decoding section 202, outputs the transform-coded data to transform coding/decoding section 243 and output the band limitation flag to target band decoding section 245.

Unit number calculating section 242 is identical to unit number calculating section 141 of speech/audio coding apparatus 140, and therefore detailed description thereof will be omitted.

Transform coding/decoding section 243 outputs the decoding result for each subband to subband integration section 246 as a decoded subband spectrum based on the transform-coded data outputted from code demultiplexing section 241, the number of units outputted from unit number calculating section 242 and band limited subband information outputted from target band decoding section 245. Note that when band-limited coded data is decoded, amplitude of all spectra outside the limited band is set to 0 and the subband length to be outputted is outputted as a spectrum of subband length W[n] before band limitation.

Transform coding result storage section 244 has functions substantially identical to those of transform coding result storage section 143 of speech/audio coding apparatus 140. However, when the influences of errors by communication channels such as frame erasure, packet loss are received, decoded subband spectra cannot be stored in transform coding result storage section 244, and therefore spectrum information of a preceding frame is set to −1, for example.

Target band decoding section 245 outputs band limited subband information to unit number calculating section 242 and transform coding/decoding section 243 based on the band limitation flag outputted from code demultiplexing section 241 and spectrum information of the preceding frame outputted from transform coding result storage section 244. Target band decoding section 245 determines whether or not to perform band limitation depending on the value of the band limitation flag. Here, when the band limitation flag is 1, target band decoding section 245 performs band limitation and outputs band limited subband information indicating the band limitation. On the other hand, when the band limitation flag is 0, target band decoding section 245 does not perform band limitation and outputs band limited subband information indicating that all spectra of the subband are coding targets. However, even when the spectrum information of the preceding frame outputted from transform coding result storage section 244 is −1, if the band limitation flag is 1, target band decoding section 245 calculates band limited subband information indicating band limitation. This is because, when the transform-coded data is not decoded in the preceding frame due to a frame erasure or the like, spectrum information of the preceding frame becomes −1, but since speech/audio coding apparatus 140 performs transform coding accompanied by band limitation, it is necessary to decode the transform-coded data based on the premise of band limitation.

Subband integration section 246 tightly arranges the decoded subband spectra outputted from transform coding/decoding section 243 from the low band side, integrates them into one vector and outputs the integrated vector to frequency/time transformation section 208 as a decoded signal spectrum.

Next, a series of operations of aforementioned speech/audio decoding apparatus 240 will be described using FIG. 18.

Here, suppose that subband n−1 is transform-coded in frame t−1 and subband n is not encoded by transform coding. Suppose that subband n−1 and subband n are transform-coded in frame t and subband n−1 is encoded by band limitation.

First, frame t will be described. Target band decoding section 245 can know, from the band limitation flag outputted from code demultiplexing section 241, whether each subband is a subband transform-coded without band limitation or a subband transform-coded after band limitation. The subband transform-coded without band limitation, subband n here, is decoded as all spectrum coding targets. Transform coding/decoding section 243 can decode coded data outputted from code demultiplexing section 241 using subband length W[n] outputted from target band decoding section 245 and the number of units outputted from unit number calculating section 242.

On the other hand, target band decoding section 245 can know, from the band limitation flag, that subband n−1 is encoded in a band-limited state. For this reason, transform coding/decoding section 243 can decode coded data outputted from code demultiplexing section 241 using band-limited subband length WL[n−1] of subband n−1 outputted from target band decoding section 245 and the number of units outputted from unit number calculating section 242.

However, if the situation remains the same, transform coding/decoding section 243 cannot identify a precise location of the decoded subband spectrum, and therefore transform coding/decoding section 243 identifies the precise location using a decoding result of subband n−1 in the preceding frame. Suppose that transform coding result storage section 244 stores P[t−1, n−1]. Target band decoding section 245 sets the band limited subband information so that the subband width becomes WL[n−1] centered on P[t−1, n−1] outputted from transform coding result storage section 244. More specifically, the start spectrum position of the band limitation subband is assumed to be P[t−1, n−1]−(int)(WL[n−1]/2) and the end spectrum position is assumed to be P[t−1, n−1]+(int)(WL[n−1]/2). The band limited subband information calculated in this way is outputted to transform coding/decoding section 243.

Thus, transform coding/decoding section 243 can dispose the decoded subband spectra at precise positions. For spectra outside the limited band indicated by band limited subband information, amplitude of the spectra is set to 0.

Upon failing to receive frame t−1 due to the influences of a communication channel and failing to decode it, transform coding result storage section 244 cannot store a correct decoding result. For this reason, in the case of a subband encoded by band limitation in frame t, decoded subband spectra cannot be arranged at correct positions. In this case, the start spectrum position and the end spectrum position of band limited subband information may be fixed so as to be close to the center of the subband, for example. Transform coding result storage section 244 may estimate them using the past decoding results. Transform coding/decoding section 243 may calculate a harmonic structure from the low band spectrum, estimate the harmonic structure in the subband and estimate the position of the spectrum with maximum amplitude.

Speech/audio decoding apparatus 240 can decode coded data encoded by band limitation through a series of the above-described operations.

Speech/audio coding apparatus 140 described above can efficiently encode a spectrum with high time continuity in a high band and speech/audio decoding apparatus 240 can obtain a decoded signal with high clarity.

Thus, Embodiment 6 encodes only bands peripheral to subjectively important spectrum in a preceding frame, and can encode a target band with a fewer bits, and can thereby improve the possibility of encoding perceptually important spectra temporally consecutively. As a result, it is possible to obtain a decoded signal with high clarity.

The disclosures of the specifications, drawings, and abstracts in Japanese Patent Application No. 2012-243707 filed on Nov. 5, 2012 and Japanese Patent Application No. 2013-115917 filed on May 31, 2013 are incorporated herein by reference in their entireties.

INDUSTRIAL APPLICABILITY

The speech/audio coding apparatus, speech/audio decoding apparatus, speech/audio coding method and speech/audio decoding method according to the present invention are applicable to a communication apparatus that performs voice call or the like.

REFERENCE SIGNS LIST

101 Time/frequency transformation section
102 Subband dividing section
103 Subband energy calculating section
104, 203, 111, 141, 211, 242 Unit number calculating section
105 Band compression section
106, 204 Unit number recalculating section
107, 142 Transform coding section
108, 145 Multiplexing section
121, 221 Subband energy attenuation section
131 Interleaver
143, 244 Transform coding result storage section
144 Target band setting section
201, 241 Code demultiplexing section
202 Subband energy decoding section
205, 243 Transform coding/decoding section
206 Band extension section
207, 246 Subband integration section
208 Frequency/time transformation section
231 De-interleaver
245 Target band decoding section

We claim:

1. A speech/audio decoding apparatus, comprising:

a receiver that receives encoded speech/audio data, including a limited-band mode flag;

a memory that stores information on a position of a maximum amplitude speech/audio spectrum frequency of a previous frame in a divided band; and a processor that identifies whether a decoding band is encoded using a limited-band mode based on the decoded limited-band mode flag, wherein the limited-band mode is set at an encoder side, when a difference between a first frequency with a first maximum amplitude in a speech/audio spectrum of the divided band in a preceding frame and a second frequency with a second maximum amplitude in a speech/audio spectrum of the divided band in a current frame is below a threshold, a width of a limited band in the current frame being narrower than the divided band and the limited band including the first frequency, and decodes the speech/audio spectrum in the limited band within each of the divided bands in the current frame using the stored information on the position of a maximum amplitude speech/audio spectrum frequency of the previous frame, when the decoding band is identified as the band encoded using the limited-band mode.

2. The speech/audio decoding apparatus according to claim 1, wherein the processor generates the position information for decoding the speech/audio spectrum in the limited band within each of the divided bands in the current frame, the position information being so that the limited band width becomes centered on the position of a maximum amplitude speech/audio spectrum frequency of the previous frame.

3. The speech/audio decoding apparatus according to claim 1, wherein one bit is used for indicating whether the limited-band mode is used as the limited-band mode flag.

4. The speech/audio decoding apparatus according to claim 1, wherein when the decoding band is identified as the band encoded not using the limited-band mode, the processor does not perform band limitation and decodes all spectra of the band.

5. A speech/audio decoding method, comprising:

receiving, by a receiver, an encoded speech/audio data, including a limited-band mode flag;

storing information in a memory on a position of a maximum amplitude speech/audio spectrum frequency of a previous frame in a divided band;

identifying, by a processor, whether a decoding band is encoded using a limited-band mode based on the decoded limited-band mode flag, wherein the limited-band mode is set at an encoder side, when a difference between a first frequency with a first maximum amplitude in a speech/audio spectrum of the divided band in a preceding frame and a second frequency with a second maximum amplitude in a speech/audio spectrum of the divided band in a current frame is below a threshold, a width of a limited band in the current frame being narrower than the divided band and the limited band including the first frequency, and decoding, by the processor, the speech/audio spectrum in the limited band within each of the divided bands in the current frame using the stored information on the position of a maximum amplitude speech/audio spectrum frequency of the previous frame, when the decoding band is identified as the band encoded using the limited-band mode.

6. The speech/audio decoding method according to claim 5, wherein the processor generates the position information for decoding the speech/audio spectrum in the limited band within each of the divided band in the current frame, the position information being so that the limited band width becomes centered on the position of a maximum amplitude speech/audio spectrum frequency of the previous frame.

7. The speech/audio decoding method according to claim 5, wherein one bit is used for indicating whether the limited-band mode is used as the limited-band mode flag.

8. The speech/audio decoding method according to claim 5, wherein when the decoding band is identified as the band encoded not using the limited-band mode, the processor does not perform band limitation and decodes all spectra of the band.

* * * * *